US006151040A

United States Patent [19]

Takada et al.

[11] Patent Number: 6,151,040

[45] **Date of Patent: *Nov. 21, 2000**

[54] IMAGE RECORDING APPARATUS FOR A CLOTH RECORDING MEDIUM

[75] Inventors: Yoshihiro Takada, Kawasaki; Akio Suzuki, Yokohama; Yasushi Miura, Kawasaki; Yasuyuki Takanaka, Yokohama; Nobuhiko Ogata, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/936,621

[22] Filed: Sep. 24, 1997

Related U.S. Application Data

[63] Continuation of application No. 08/022,555, Feb. 25, 1993, abandoned.

[30] Foreign Application Priority Data

Feb. 26, 1992 [JP] Japan ..... 4-039670
Feb. 18, 1993 [JP] Japan ..... 5-028913

[51] Int. Cl.[7] ..... B41J 29/38

[52] U.S. Cl. ..... 347/14; 347/106

[58] Field of Search ..... 347/14, 16, 19, 347/101, 104, 105, 106, 102; 8/445, 449, 529; 26/70; 356/238; 73/159, 160

[56] References Cited

U.S. PATENT DOCUMENTS

| | | | |
|---|---|---|---|
| 4,087,825 | 5/1978 | Chen et al. | 347/101 X |
| 4,248,533 | 2/1981 | Shimada | 356/238 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,725,849 | 2/1988 | Koike et al. | 347/106 |
| 4,740,796 | 4/1988 | Endo et al. | 347/56 |
| 4,797,687 | 1/1989 | Holder et al. | 347/19 |
| 4,847,638 | 7/1989 | Moriyama | 347/101 |
| 4,963,882 | 10/1990 | Hickman . | |
| 4,967,203 | 10/1990 | Doan et al. . | |
| 4,984,181 | 1/1991 | Kliman et al. | 364/518 |
| 5,004,928 | 4/1991 | Suzuki et al. . | |
| 5,084,758 | 1/1992 | Danzuka et al. . | |
| 5,394,247 | 2/1995 | Vahey et al. | 73/159 |

FOREIGN PATENT DOCUMENTS

| | | | |
|---|---|---|---|
| 54-056847 | 5/1979 | Japan . | |
| 56-146769 | 11/1981 | Japan | 347/14 |
| 58-155960 | 6/1983 | Japan | 347/19 |
| 59-123670 | 4/1984 | Japan . | |
| 60-071260 | 4/1985 | Japan . | |
| 60-105546 | 6/1985 | Japan . | |
| 60-230764 | 11/1985 | Japan . | |
| 61-6366 | 1/1986 | Japan . | |
| 62-053492 | 3/1987 | Japan . | |
| 1264852 | 10/1989 | Japan . | |
| 2-53976 | 2/1990 | Japan . | |
| 3-28727 | 2/1991 | Japan . | |
| 3150177 | 6/1991 | Japan . | |
| 3046589 | 7/1991 | Japan . | |
| 3155951 | 7/1991 | Japan . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An image recording apparatus for moving, relatively to a cloth recording medium, a recording head for discharging ink so as to record an image. The image recording apparatus is arranged such that the operation conditions of the recording head can be changed at the time of the recording operation in accordance with the thickness of the cloth, or the diameter of the fiber or the pitch of weaving the fiber of the cloth, so that the quantity of ink to be supplied to the cloth to record an image is controlled so that a high quality recorded image can be obtained regardless of the type of the cloth.

29 Claims, 29 Drawing Sheets

CLOTH A

CLOTH B

CLOTH A $\Delta T_A \leqq \quad t_1 = \frac{X_A}{V}$

CLOTH B $\Delta T_B \leqq \quad t_2 = \frac{X_B}{V} \quad t_2 > t_1$ $X_B > X_A$

CLOTH A

CLOTH B

IMAGE RECORDING APPARATUS FOR A CLOTH RECORDING MEDIUM

This application is a continuation of application Ser. No. 08/022,555 filed Feb. 25, 1993, now abandoned.

BACKGROUND OF THE INVENTION

1. Field of the Invention

The present invention relates to a method and an apparatus for recording an image on a recording medium by moving a recording head having a plurality of recording elements relatively to the recording medium, and to an article produced in the recording operation.

2. Description of the Related Art

A conventional textile printing apparatus is typified by an apparatus adapted to a silk screen printing method in which a silk screen stencil is used to directly print an image on a cloth or the like. With the screen printing method, screen stencils are made for all of the colors used in the original image to be printed and ink is directly transferred to the cloth through the space in the silk so that the cloth is dyed.

However, the screen printing method requires great labor and takes an excessively long time to make the screen stencils, and, what is worse, a complicated operation for preparing ink for each color and that for aligning the screen stencils must be performed. Furthermore, a printing apparatus adapted to the aforesaid method has an excessively large size in proportion to the number of colors for use in the printing operation and therefore it requires a large installation space. Moreover, a space in which the screen stencils are stocked is required.

SUMMARY OF THE INVENTION

While considering the aforesaid problems experienced with the related art, the present invention has been found on the basis of completely novel discoveries.

In order to overcome the aforesaid technological problems experienced with the related art, an object of the present invention is to provide an image recording method and an image recording apparatus enabling a high quality recorded image to be always obtained regardless of the type of the recording medium and to provide a recorded product obtained by the image recording apparatus.

Another object of the present invention is to provide an image recording method and an image recording apparatus for moving, relatively to a cloth recording medium, a recording head for discharging ink so as to record an image. The apparatus includes instruction means for generating an instruction signal based on the thickness of the cloth, the diameter of the fiber of the cloth, or the weaving pitch of the fiber of the cloth; and recording control means for changing the operation conditions of the recording head in accordance with the instruction signal. The recording method includes the steps of providing the apparatus, applying ink to the cloth, and fixing the applied ink to the cloth.

Another object of the present invention is to provide an image recording method and an image recording apparatus for moving, relatively to a cloth recording medium, a recording head for discharging ink so as to record an image. The apparatus includes detection means for detecting the thickness of the cloth, the diameter of the fiber of the cloth, or the weaving pitch of the fiber of the cloth and for accordingly generating a detection signal; and recording control means for changing the operation conditions of the recording head in accordance with the detection signal generated by the detection means. The recording method includes the steps of providing the apparatus, applying ink to the cloth, and fixing the applied ink to the cloth.

Another object of the present invention is to provide an image recording method and apparatus for moving, relatively to a cloth recording medium, a recording head for discharging ink so as to record an image. The apparatus includes determining means for determining a type of recording medium; heating means for heating the recording head; temperature detection means for detecting the temperature of the recording head; and heating control means for controlling the heating means so as to maintain the temperature of the recording head at a desired level in accordance with the determined type of the recording medium. The recording method includes the steps of providing the apparatus, applying ink to the cloth, and fixing the applied ink to the cloth.

Another object of the present invention is to provide an image recording method and an image recording apparatus for moving, relatively to a cloth recording medium, a recording head for discharging ink-so as to record an image. The apparatus includes determining means for determining the type of the cloth recording medium; and changing means for changing the operation frequency of the recording head in accordance with the type of the cloth recording medium determined by the determining means. The recording method includes the steps of providing the apparatus, applying ink to the cloth, and fixing the applied ink to the cloth.

The term "cloth" used in this specification includes all of woven and unwoven fabrics and cloths regardless of the material, the style of weaving and the style of knitting.

As the recording medium, for example, cloth, paper and wall paper made of such as polyvinylchloride can be used.

It should be noted that the term "recording" used in the present specification and claims includes a meaning of "printing" and signifies in a broad sense providing an image on recording media such as cloth made of cotton or silk, etc. and paper. It should be also noted that the term "recording" is not meant to limit the scope of the invention.

Other and further objects, features and advantages of the invention will be appear more fully from the following description.

DETAILED DESCRIPTION OF THE PREFERRED EMBODIMENTS

Preferred embodiments of the present invention will now be described with reference to the drawings.

Figure 1:
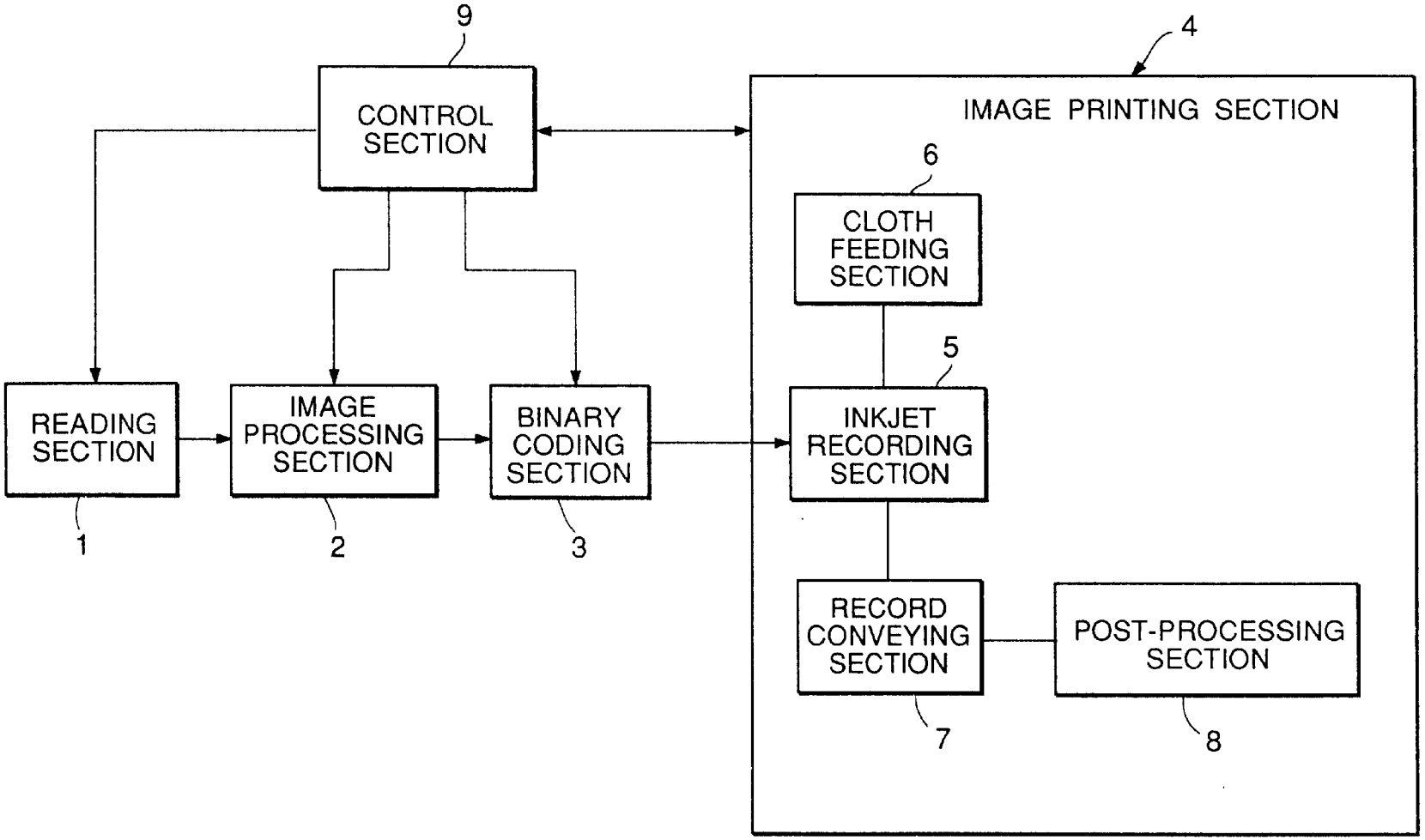
FIG. 1 illustrates the system structure of a dyeing apparatus according to an embodiment of the present invention.

FIG. 1 schematically illustrates the structure of a copying system according to an embodiment of the present invention.

The copying system has a structure incorporating a reading section 1 for reading an original image made by a designer or the like, an image processing section 2 for processing image data read from the original image, a binary-coding section 3 for binary-coding image data processed by the image processing section 2, and an image printing section 4 for printing the image on a cloth in accordance with the binary-coded image data.

The reading section 1 reads the original image with a CCD image sensor so as to output the read image as an electric signal to the image processing section 2. The image processing section 2 generates recording data in accordance with the supplied original image data, the recording data being used to actuate an ink jet recording section 5 to be described later and arranged to discharge magenta, cyan, yellow and black colors. In order to generate the recording data, an image processing operation for reproducing the original image by means of dots, a color coordinating operation for determining the color tone, an operation for changing the layout and a size selection operation for enlarging/reducing the size of the pattern are performed.

The image printing section 4 has an ink jet recording section 5 for discharging ink in accordance with the recording data, a cloth feeding section 6 for feeding a cloth to the ink jet recording section 5, a recording and conveyance section 7 disposed to face the ink jet recording section 5 so as to precisely convey the cloth, and a post-processing section 8 for subjecting the cloth, on which the image has printed, to post-processing and accommodating the printed cloth.

First, the ink jet recording section 5 will be described.

Figure 2:
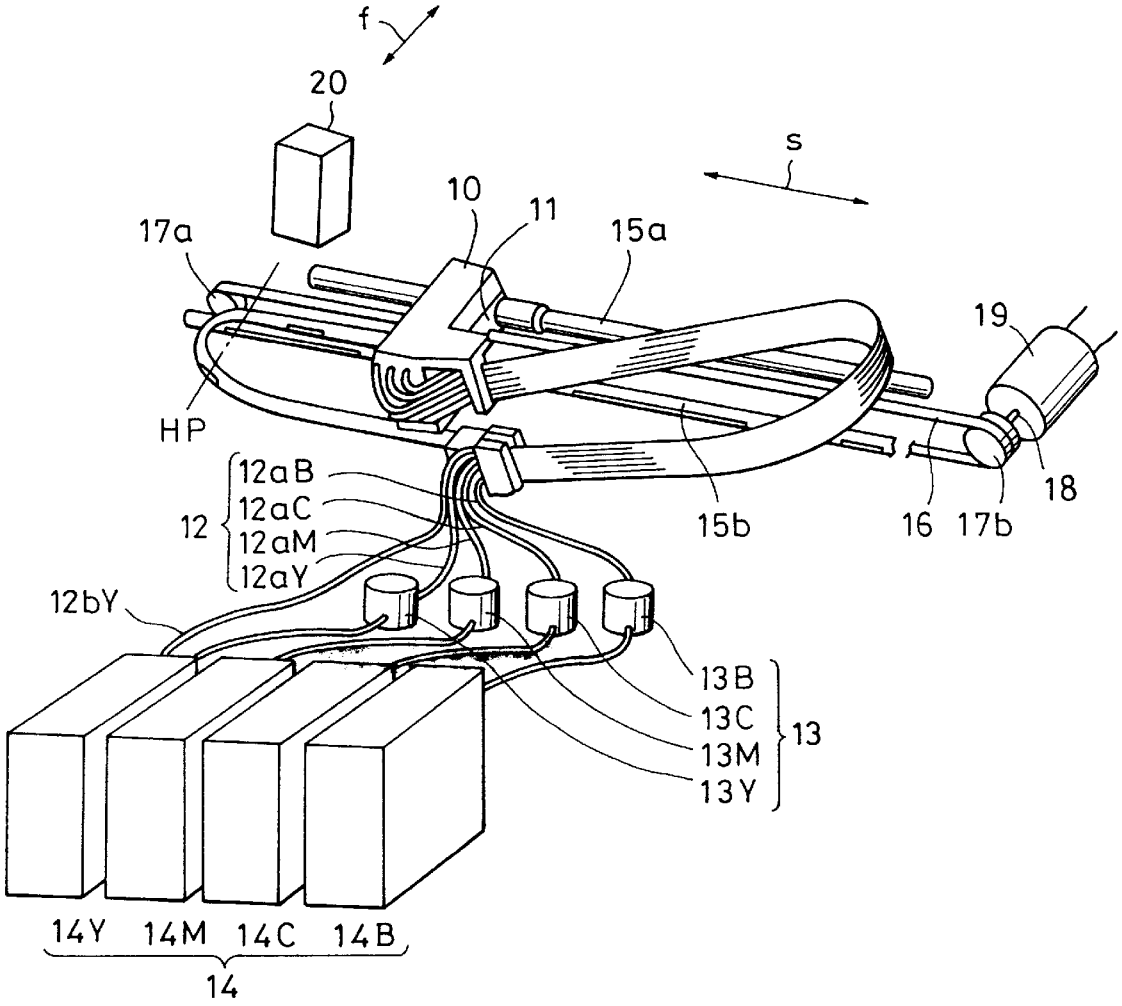
FIG. 2 is a schematic view which illustrates an ink jet recording section of the dyeing apparatus according to the embodiment.

As shown in FIG. 2, the ink jet recording section 5 comprises two guide rails 15*a* and 15*b*, an ink jet head (recording head or recording head array) 10, a carriage 11 for carrying the ink jet head (recording head) 10, an ink supply device, a head restoring device 20 and an electric system (omitted from illustration). The ink supply device accumulates ink to be supplied to the recording head 10 as a required. The ink supply device including an ink tank 14, an ink pump 13 and the like. The ink supply device and the recording head 10 are connected to each other by an ink supply tube 12. The ink supply device ordinarily automatically supplies ink to the recording head 10 for compensating for the quantity of the ink discharged from the recording head 10 due to a capillary effect. At the time of a head restoring action to be described later, an ink pump 13 is used to forcibly supply ink to the recording head 10.

The recording head 10 and the ink supply device are mounted on a head carriage 11 and an ink carriage (not shown), the carriage 11 being secured to a belt 16 arranged between a pulleys 17*a* and 17*b*. The carriage 11 is so constituted as to be reciprocated in a direction designated by an arrow S along the guide rails 15*a* and 15*b* when the pulley 17 fastened to a rotational shaft of a carriage motor 19 is rotated.

The head restoring device 20 is disposed so as to face the recording head 10 at a home position HP in order to maintain the stability of the recording head 10. Specifically, the head restoring device 20 moves in a direction designated by an arrow f at the time of the non-operation to cap the recording head 10 (capping operation) at the home position in order to prevent evaporation of ink from the nozzle of the recording head 10. Furthermore, the head restoring device 20 recovers discharged ink forcibly discharged from the nozzle by pressure applied to the ink passage of the recording head 10 by actuating the ink pump in order to discharge bubbles and dust from the nozzle before the image recording operation is commenced.

Figure 3:
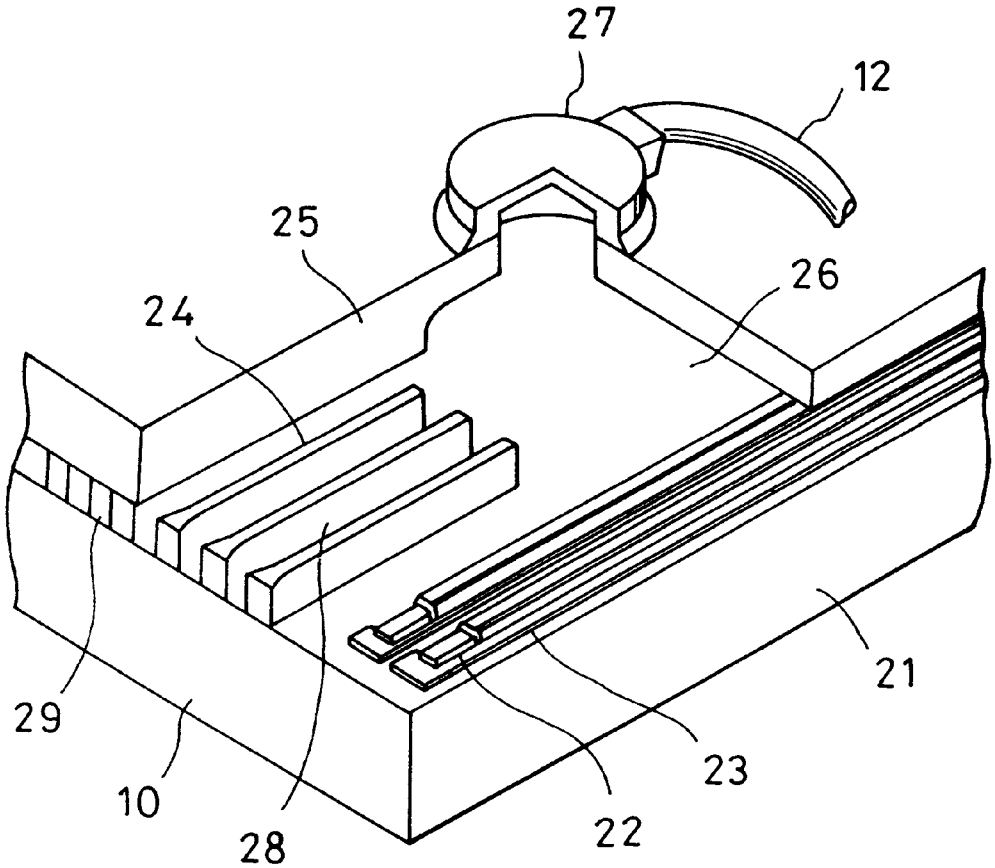
FIG. 3 is a schematic view which illustrates an ink jet recording head according to the embodiment of the present invention.

FIG. 3 is a perspective view which illustrates the schematic structure of the ink jet recording head 10 which is composed of an electricity-to-heat convertor 22, an electrode 23, a nozzle wall 24 and ceiling plate 25 and the like which are formed on a substrate 21 by a semiconductor manufacturing process including etching, evaporating and sputtering operations.

Recording ink is supplied from the ink tank 14 shown in FIG. 2 into a common liquid chamber 26 of the recording head 10 via the ink supply tube 12. Referring to FIG. 3, reference numeral 27 represents a supply pipe connector. Ink thus supplied into the common liquid chamber 26 is supplied into the nozzle 28 due to the capillary phenomenon and ink is stably held at the surface of the discharge port formed at the leading portion of the nozzle because of the formed meniscus. When the electricity-to-heat converter 22 is actuated, ink present on the surface of the electricity-to-heat converter 22 is heated so that a bubble generation phenomenon takes place. The energy of the bubble generation causes an ink droplet to be discharged from a discharge port surface 29.

Thanks to the structure thus arranged, an ink jet recording head can be manufactured in which 128 or 256 nozzles are disposed at a high density of 16 nozzles/mm.

Figure 4:
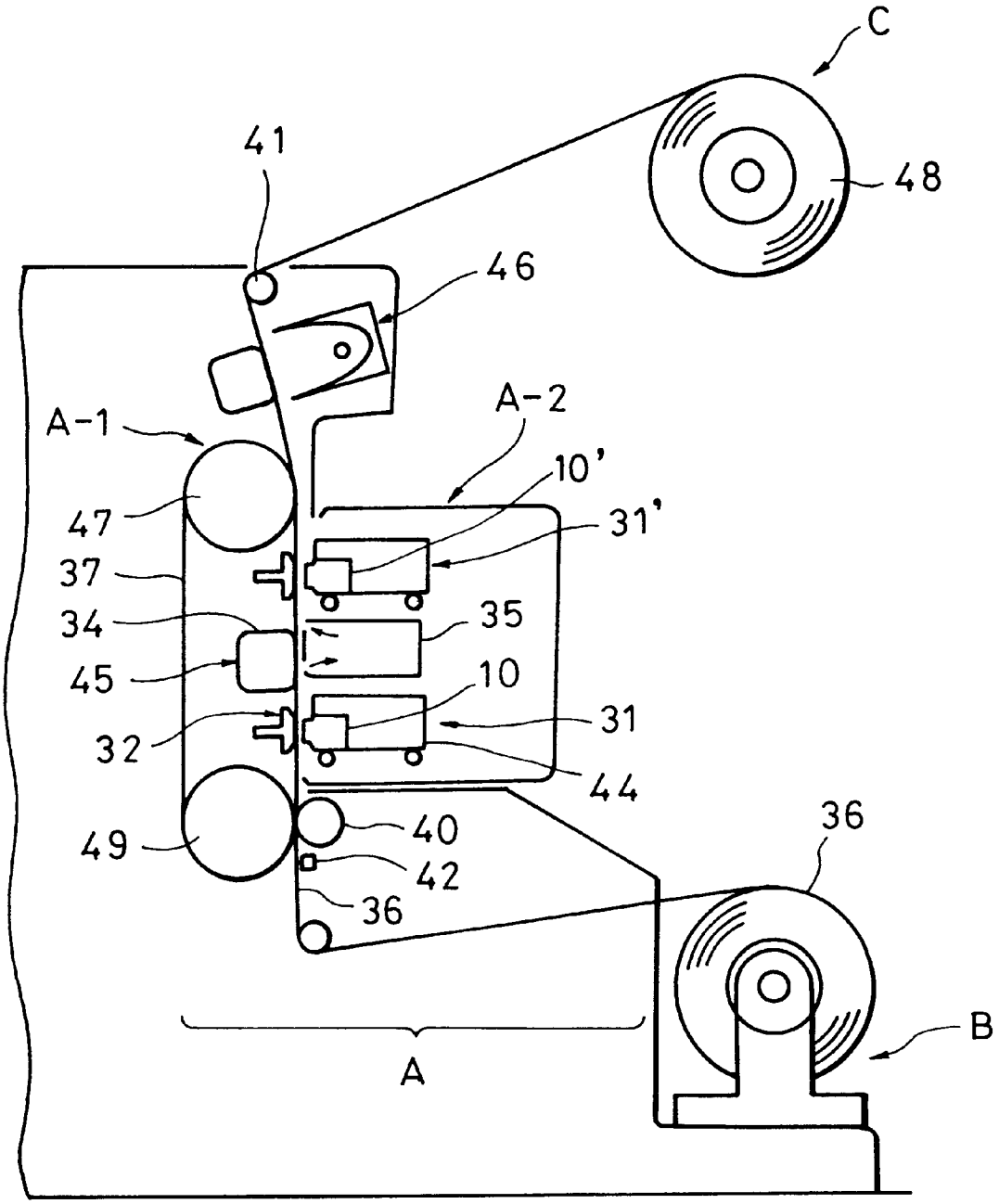
FIG. 4 illustrates an example of the structure of an ink jet printer serving as a textile printing apparatus according to the present invention.
Figure 5:
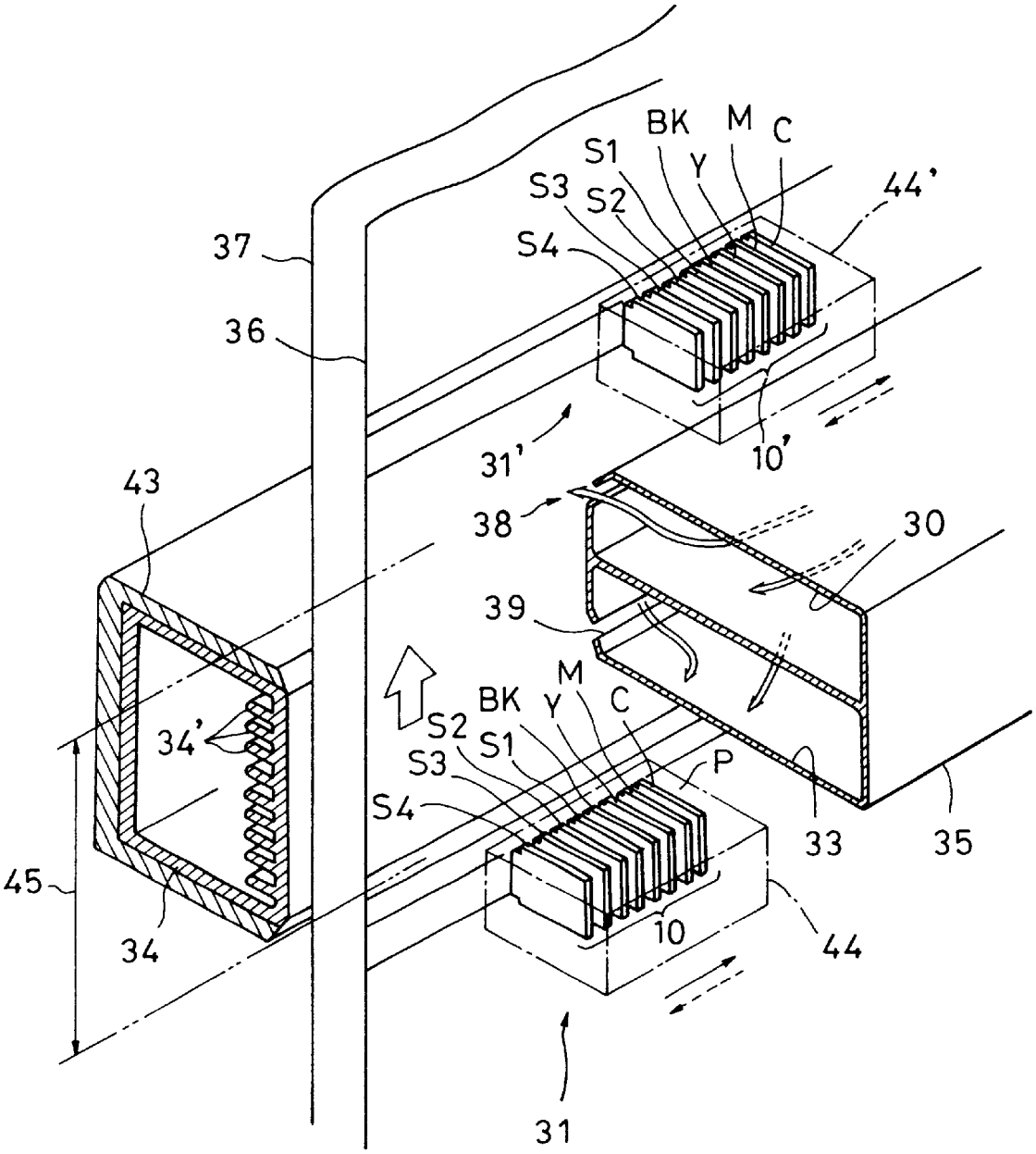
FIG. 5 is an enlarged perspective view which illustrates an essential portion of the ink jet printer shown in FIG. 4.

FIG. 4 illustrates the structure of an ink jet printer which is the textile printing apparatus according to an embodiment of the present invention. FIG. 5 is an enlarged perspective view which illustrates an essential portion of the ink jet printer shown in FIG. 4. The textile printing apparatus (the printer) comprises a cloth supplying section B for supplying the cloth provided on a roll and that was subjected to pre-treatment for the textile printing operation, a body portion A for precisely moving the supplied cloth and printing an image by using the ink jet head, and a taking-up section C for drying and taking up the printed cloth. The body portion A comprises a precise supplying section A-1, which has a platen, and a platen unit A-2.

The rolled cloth 36, which has been subjected to the pre-treatment, is moved toward the cloth supply section B so as to be received by the body portion A. In the body portion A, an endless thin belt 37, which is precisely step-driven, is arranged between a drive roller 47 and a winding roller 49. The drive roller 47 is directly step-driven by a high resolution stepping motor (omitted from illustration) so that the belt 37 is incrementally moved by small steps. The conveyed cloth 36 is pushed against the surface of the belt 37 by a pressing roller 40 at a position where the winding roller 39 supports the belt 37 so that the cloth 36 moves with the belt 37.

The cloth 36 step-conveyed by the belt 37 is aligned to a predetermined position by a platen 32 positioned on the back side of the belt 37 adjacent a first printing section 31 so as to be printed by the ink jet head 10. Whenever one line has been printed, the cloth is step-moved by a predetermined quantity. Then, the cloth is dried by heat supplied from the back side of the belt and generated by a heating plate 34 and hot air supplied/discharged from the surface and generated by a hot air duct 35. Then, the cloth 36 is stack-printed by a second printing section 31' by a method similar to that effected by the first printing section 31.

A preferable mode here is such that by the head in the first printing section 31, the information is recorded while thinning the number of dots and then, after the cloth moving process and the drying process, the ink droplets are ejected by the head in the second printing section 31' to complement the information which has been thinned in the first printing unit.

The printed cloth is separated from the belt 37, and then the cloth is again dried by a post-drying section 46 comprising another heating plate and hot air duct. Then, the cloth is guided out of the body portion A by a guide roll 41 and taken up by a winding roller 48. The taken up cloth is removed from the apparatus so as to be subjected to post-processing consisting of color attaining, cleaning and drying operations to be performed in a batch manner, which results in finished products.

As shown in FIG. 5, the cloth 36, which is the recording medium, is pressed against the belt 37 so as to be step-moved in an upward direction when viewed in the drawing. The first printing section 31 disposed in the lower portion of FIG. 5 includes a first carriage 44 on which Y, M, C, BK and special colors S1 to S4 ink jet heads 10 are mounted. Each ink jet head according to this embodiment has a plurality of elements for generating heat energy which causes film boiling to take place in the ink and includes 128 discharge ports disposed at a density of 400 DPI (dot/inch).

A drying section 45 comprising the heating plate 34 for heating the cloth from the back side of the belt and a hot air duct 35 for drying the surface of the cloth is disposed down-stream from the first printing section 31 in the conveying direction. The heat conducting surface of the heating plate 34 is pushed against the endless belt 37 with strong tension so as to intensely heat the conveyance belt 37 from its back side by hot and high pressure vapor which passes through the hollow inside portion of the heating plate 34. The conveyance belt 37 directly and effectively heats the cloth 36 due to heat conduction. The inside portion of the heating plate 34 has fins 34' for accumulating heat so that the heat is effectively concentrated to the back side of the belt 37. A portion of the heating plate 34 which is not in contact with the belt 37 is covered with a heat insulating member 43 so as to prevent heat loss due to heat radiation.

The surface of the cloth 36 is effectively dried by dry hot air having a lower humidity supplied through the supply duct 30 disposed downstream of the return duct 33. Air flows in a direction opposing the direction in which the cloth 36 is conveyed, absorbs sufficient moisture, and is sucked with an absolute pressure considerably larger than the pressure at which the air is supplied so that surrounding mechanical devices are protected from dew condensation. Hot air is supplied from a source disposed at an unshown position from the right side taken viewing FIG. 5, while air is sucked from the left side of FIG. 5 so that the difference between the pressure at an air ejection port 38 and that at a suction port 39 is made to be uniform over the lengthwise direction. The air ejection/suction section is disposed downstream with respect to the heating plate 34, which is disposed on the opposite side of the belt 37 so that air is supplied to the portion which has been heated sufficiently. As a result, the first printing section 31 efficiently removes a large quantity of the water content in the ink including a thinner, which has been absorbed by the cloth.

Downstream (upper position) of the direction in which the cloth 36 is conveyed, a second printing section 31' is disposed which has a second carriage 44' constituted similarly to the first carriage 44, and a second ink jet head array 10' is also disposed similar to head array 10.

The operation of the ink jet recording section 5 will now be described.

In response to a recording starting signal, the operation of the ink jet recording section 5 is commenced. First, a pressure application restoring operation is performed while capping the recording head 10. Then, the capping section of the restoring device 20 is removed from the recording head 10, and then the recording head 10 is moved from the home position to the start position at which the recording head 10 is stopped temporarily. When image data is supplied from the image processing section 2, the recording head 10 and the ink supply device reciprocate on the guide rail 15 (hereinafter this operation is called a "main scanning movement" or simply called "main scanning"). At this time, ink is discharged from the recording head 10 to the cloth held to face the recording head 10 in accordance with the image data so that an image is formed. After the recording head has completed one reciprocation operation, the cloth is conveyed in the sub-scanning direction by a quantity corresponding to the width of the recorded image (the width which can be recorded by the ink jet head 10) so that the next main scanning movement can be performed. After images for one page (sheet) have been recorded by repeating the aforesaid operation, the recording head 10 is moved to the home position so as to be capped by the restoring device 20.

By repeating the aforesaid operation to complete the operation of recording an image on the cloth by a predetermined length, images are recorded on a rolled cloth. Although the roll cloth has a finite length, it is able to be joined to the next roll when the trailing end of the rolled cloth is removed from the core of the roll so that recording can be continued. A colored thread is used to join up the two rolled cloths by sewing so as to be detected by a density detection sensor 42 disposed in the upper stream from the pressing roller 40. As a result, the recording operation is temporarily stopped when the joined portion has moved to a position immediately before the recording head 10 and the aforesaid one cycle recording (one scanning) has been completed. Then, the cloth is conveyed to a position by a predetermined quantity at which the cloth is positioned immediately downstream from the recording head 10. Then, the recording operation is restarted. Hence, contamination of the cloth or breakage of the recording head 10 can be prevented, the contamination or the breakage being caused due to a fact that the recording head 10 would rub the joined portion at the time of the scanning operation because of an increase in the thickness of the joined position of the cloths by sewing.

Since the recorded cloth is subjected to the process in which the solvent and the water components contained in the ink are removed by the post-drying section 46, an undesirable change of the color tone of the image formed on the wound cloth that would take place due to an influence of the solvent and the water and the like is prevented.

When image data is recorded on the cloth by the recording or dyeing apparatus according to the present invention, the manner in which ink droplets discharged from the recording head 10 are absorbed by the cloth becomes different if the diameter of the fiber, the weaving pitch, or the thickness of the cloth or the like is different.

Figure 6:
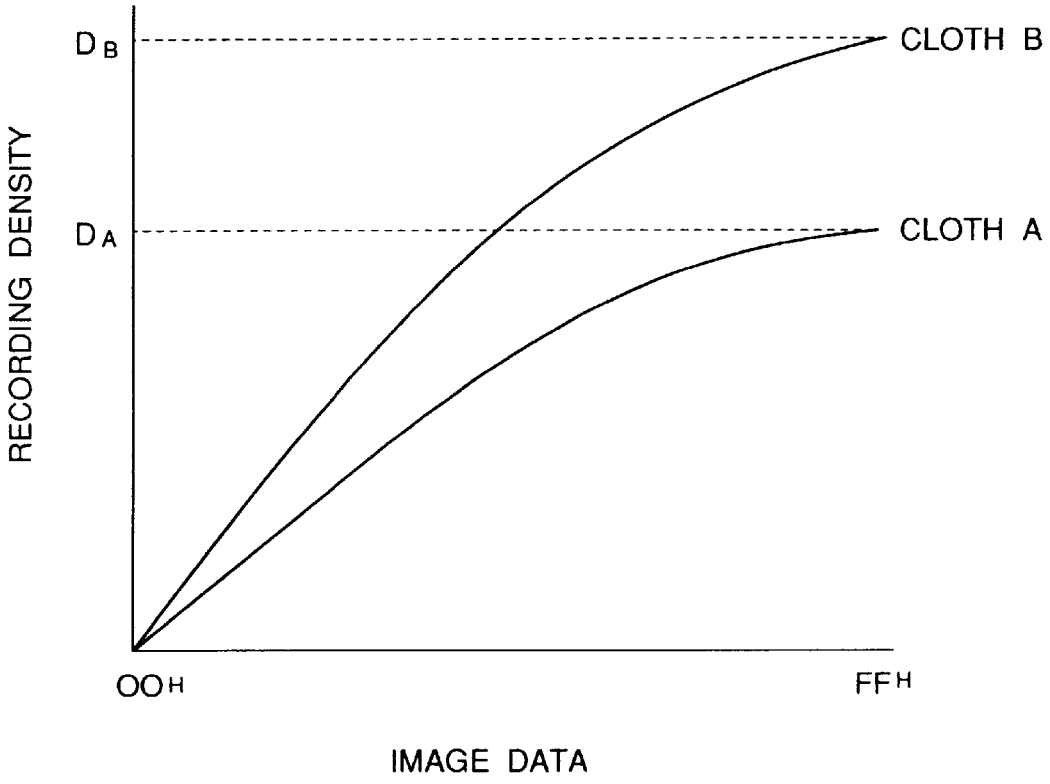
FIG. 6 is a graph which illustrates the recording densities realized with cloths in which ink is absorbed in different manners.

FIG. 6 is a graph which illustrates the change of the density of the formed image depending upon the types of the cloths. In the horizontal axis of FIG. 6, 0 to 256 gradations (00H to FFH) are shown.

As shown in FIG. 6, a problem arises in that the recording densities $D_A$ and $D_B$ become considerably different depending upon the cloths A and B, which are the recording mediums, and therefore the equal quality of the recorded images cannot be obtained even if the same density image data is recorded by the recording head 10 in accordance with, for example, 8-bit image data. What is worse, a problem sometimes arises depending upon the type of the cloth in that the quality of the recorded image deteriorates excessively due to bleeding of the recorded image that takes place when ink discharged from the recording head 10 cannot be completely absorbed by the cloth and overflows on the surface of the cloth.

Figure 7A:
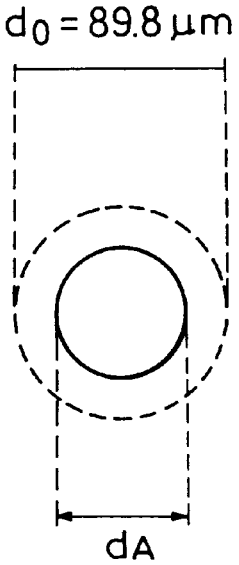
FIGS. 7(A) and 7(B) illustrate recorded dots formed on cloths in which ink is absorbed in different manners.
Figure 7B:
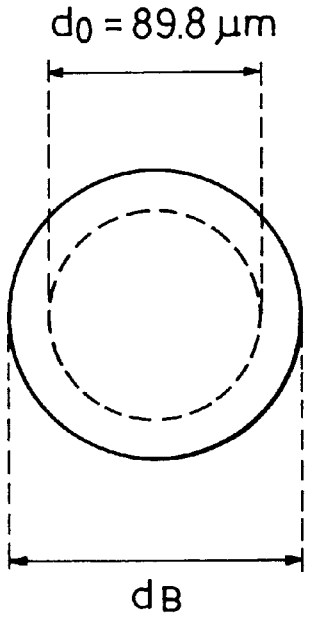

Even if the recorded image does not deteriorate due to the overflow of ink, the diameters of the recorded dots formed on the cloth by droplets discharged from the recording head become different depending upon the type of the cloth as shown in FIGS. 7A and 7B.

If a dot is recorded at a recording density of 400 dpi, similar sharpness of the recorded images cannot be obtained as can be seen in FIG. 7A in which the recorded dot diameter $d_A$ becomes too small ($d_0>d_A$) with respect to an ideal dot diameter $d_0=89.8$ $\mu$m and as can be seen FIG. 7B in which the recorded dot diameter $d_B$ becomes larger than $d_0$ ($d_0<d_B$). Therefore, there arises a problem in that the types of the cloths, on which an image can be stably recorded while maintaining high quality, are limited.

<First Embodiment>

In order to enable images to be recorded on various types of cloths while maintaining the same high quality, this embodiment is arranged in such a manner that the conditions of the recording operation performed by the recording head 10 are changed depending upon the selected type of the cloth so as to enable the ink jet recording head 10 to perform the recording operation under the optimum conditions for the selected cloth to be recorded. Therefore, this embodiment has an arrangement that the ink droplet quantity P to be discharged from each nozzle of the recording head 10 is, as a recording condition for the recording head 10, controlled so as be adaptable to the type of the cloth.

Figure 8:
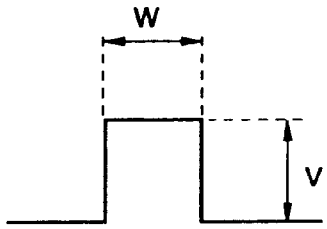
FIG. 8 illustrates a pulse signal to be supplied to the recording head.

That is, when an ink droplet is discharged from the ink jet recording head 10 according to this embodiment, a pulse signal as shown in FIG. 8 and having a pulse width of W ($\mu$sec) is, at voltage V, applied to an electricity-to-heat converter 22 of each nozzle. As a result of a bubble forming phenomenon that takes place on the surface of the electricity-to-heat converter 22, the ink droplet is discharged from each nozzle.

Figure 9:
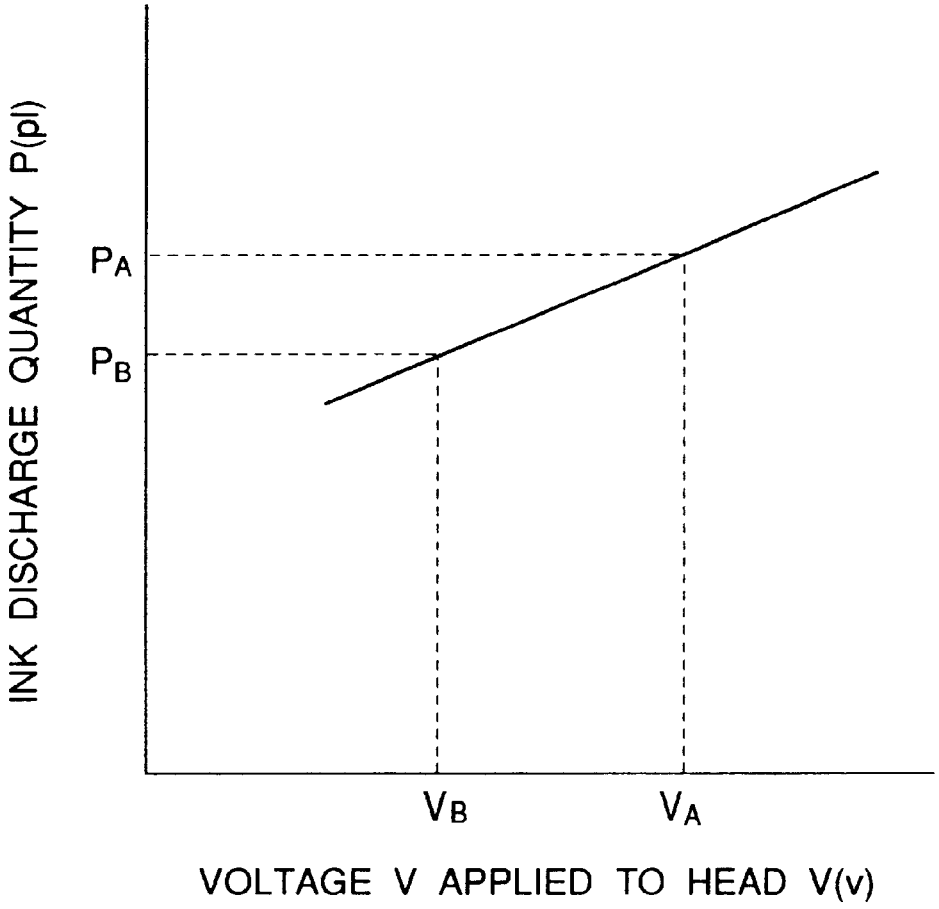
FIG. 9 is a graph which illustrates the relationship between voltage supplied to the recording head and the quantity of discharged ink realized in the first embodiment of the present invention.

By raising the pulse voltage level of the pulse signal to be applied to the electricity-to-heat converter 22 of the recording head 10 as shown in FIG. 9, the quantity P (p1) of ink to be discharged from each nozzle of the recording head 10 can be increased. Therefore, the voltage level of the pulse signal to be applied to the electricity-to-heat converter 22 of the recording head 10 is changed depending upon the type of the cloth. If the cloth A adaptable to a low recording density as shown in FIG. 7A is recorded, the voltage is set to high level $V_A$ ($V_A>V_B$: $V_B$ is the pulse voltage adapted to the cloth B shown in FIG. 7B) so that the ink droplet quantity to be discharged from the recording head 10 is increased to $P_A$ ($P_A>P_B$: $P_B$ is the quantity of discharged ink with respect to the pulse voltage $V_B$). As a result, an ink droplet of the quantity suitable for the cloth is recorded on the cloth. Hence, an image having the optimum dot diameter and satisfactory quality can be formed on the cloth while overcoming the problems of the deterioration of the density of the recorded image and the overflow of ink.

Figure 10:
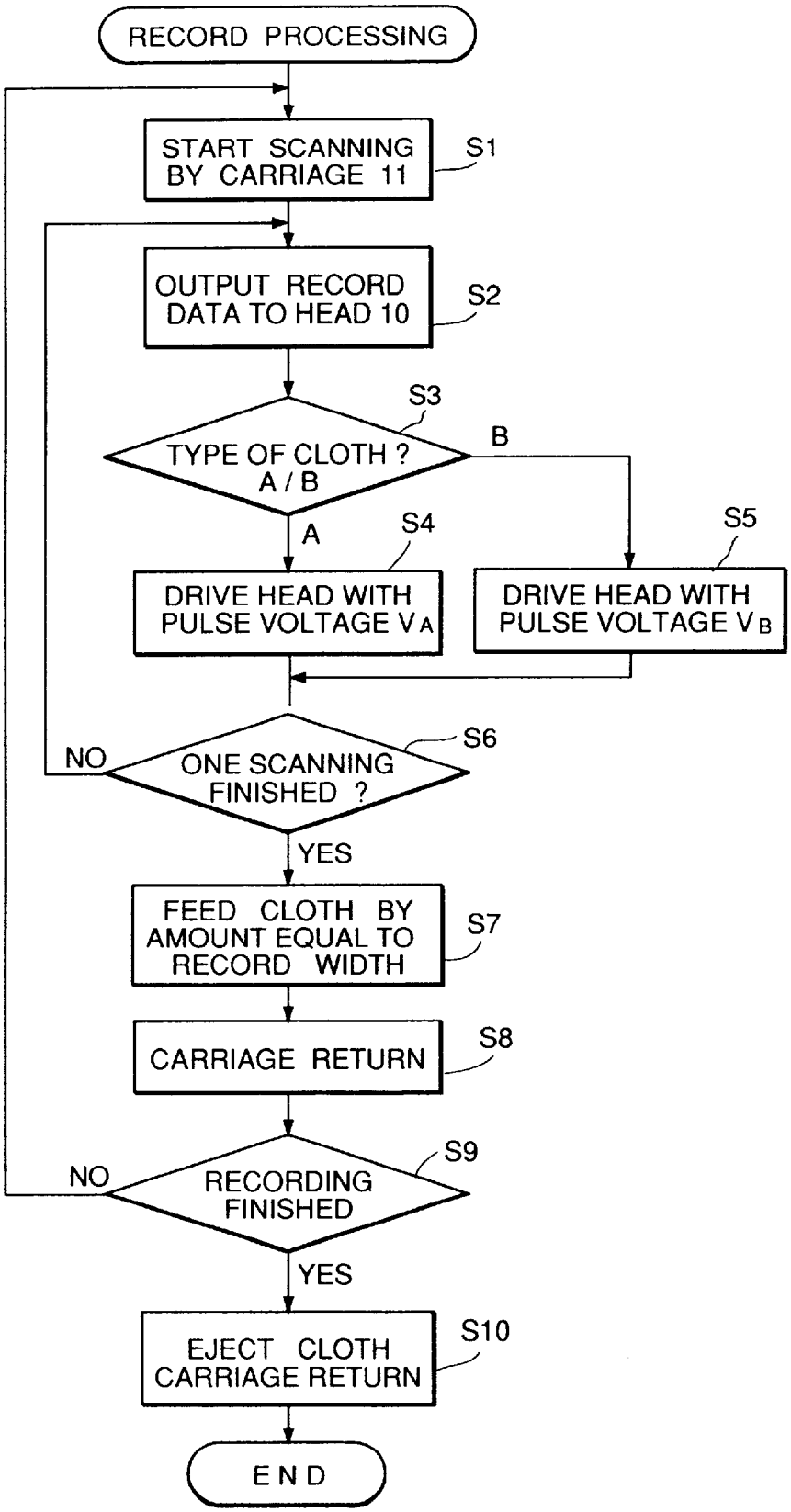
FIG. 10 is a flow chart which illustrates the recording operation according to a first embodiment of the present invention.

FIG. 10 is a flow chart which illustrates the process to be performed by a control section 9 in the aforesaid recording operation. The process is commenced when data to be recorded is prepared. In step S1, the scanning with the carriage 11 is commenced. In step S2, data to be recorded is transmitted to the recording head 10. In step S3, the type of the cloth to be recorded is detected, the type of the cloth being inputted by using a control panel or a dip switch. As an alternative to this, the type of cloth may be optically or mechanically detected as described later. The type of the cloth is categorized as cloth A on which an image is recorded at a low recording density and cloth B on which an image is recorded at a density higher than that of the actual image data. If the image is recorded on the cloth A, the flow proceeds to step S4 in which the recording head 10 is actuated at the pulse voltage of $V_A$. If the image is recorded on the cloth B, the flow proceeds to step S5 in which the recording head 10 is actuated at the pulse voltage Of $V_B$. It should be noted that the timing of the actuation is made so as to be in synchronization with the scanning operation performed by the recording head 10.

Then, the flow proceeds to step S6 in which whether or not the operation of scanning of one line has been completed by the carriage 10 is examined. If the one line has not been completed, the flow returns to step S2 and the aforesaid processes are repeated. If the operation of scanning the one line has been completed, the flow proceeds to step S7 in which the cloth is conveyed by a distance corresponding to the recordable width. In next step S8, the carriage returning operation is performed in which the carriage 11 is returned to the home position. The flow then proceeds to step S9 in which whether or not the recording operation has been completed is examined. If the recording operation has not been completed, the flow returns to step S1 and the aforesaid processes are performed. When the recording operation has been completed as described above, the flow proceeds to step S10 in which the recorded cloth is discharged and the carriage 11 is returned to the home position.

<Second Embodiment>

Figure 11:
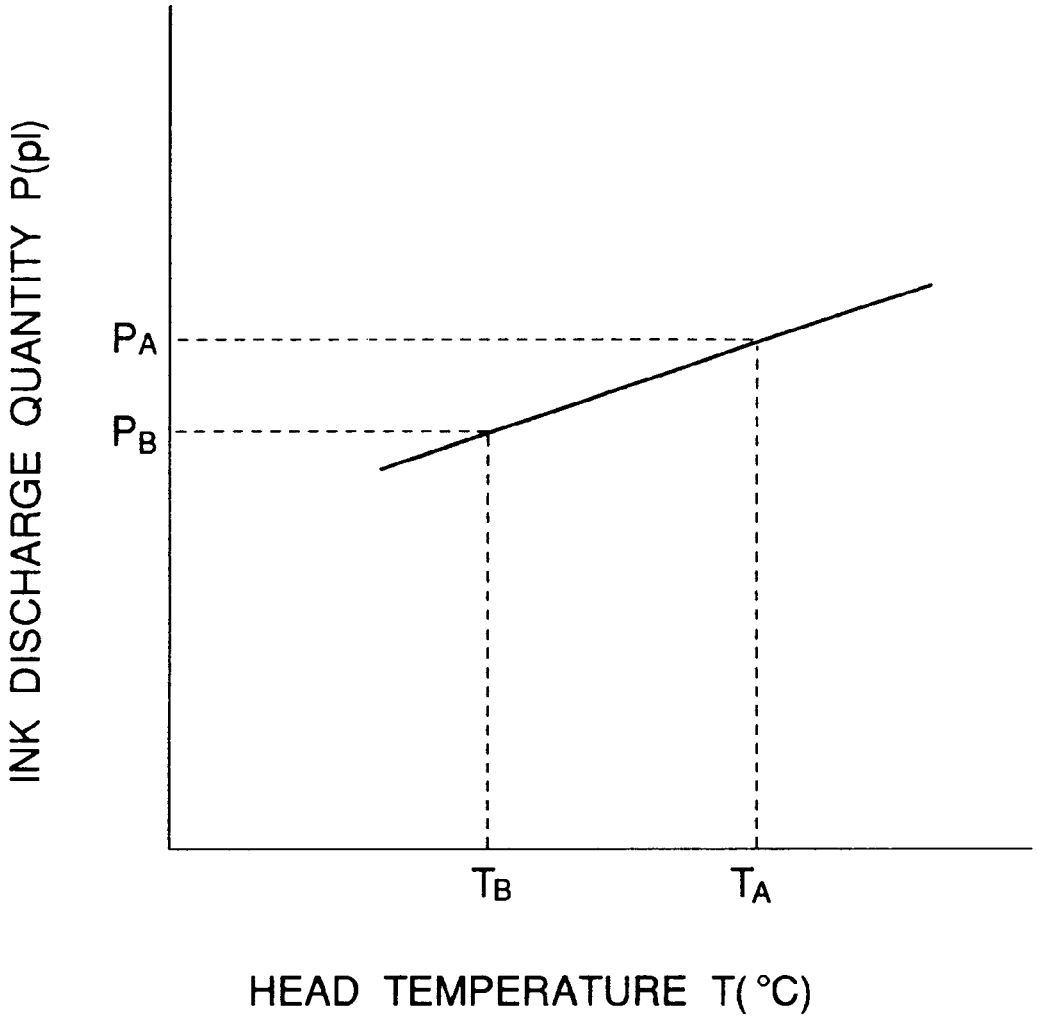
FIG. 11 is a graph which illustrates the relationship between the temperature of the recording head and the quantity of discharged ink realized in a second embodiment of the present invention.
Figure 12:
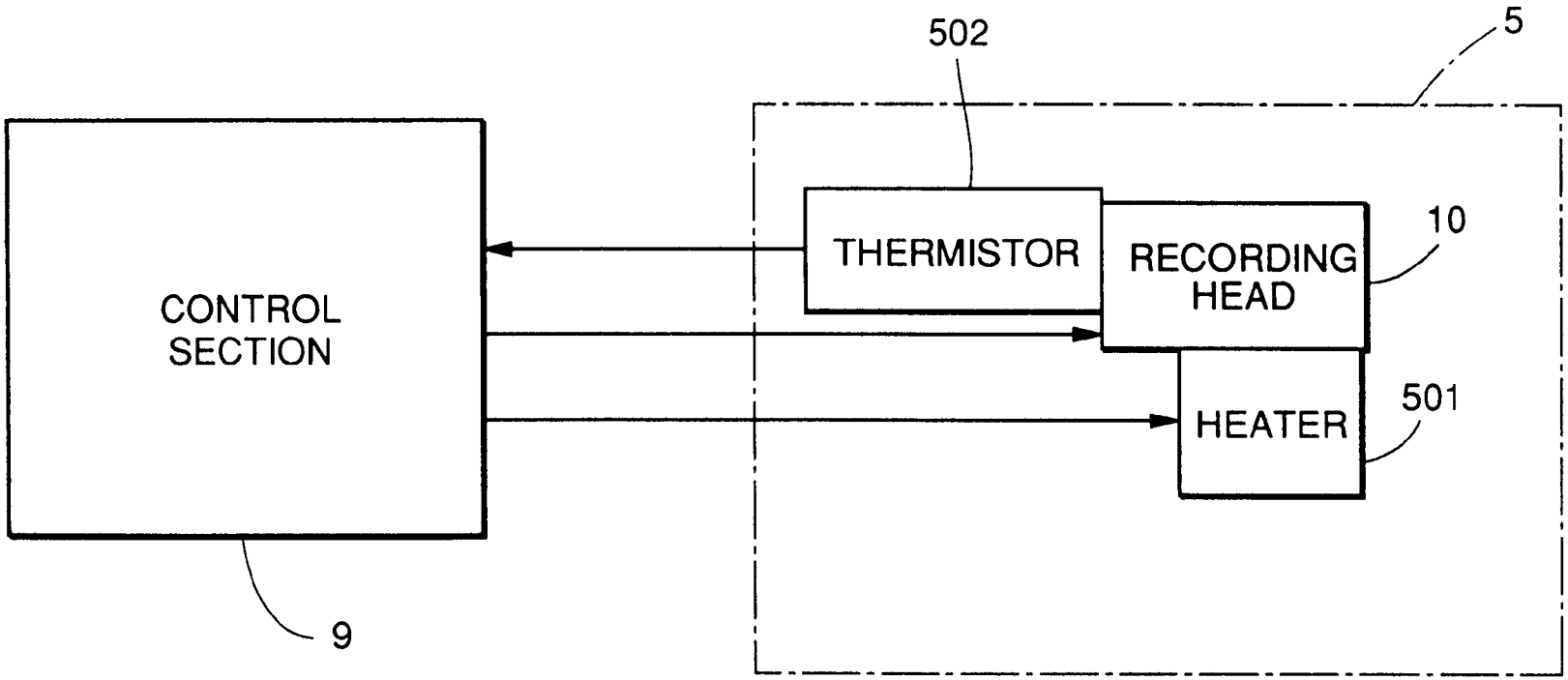
FIG. 12 is a schematic view which illustrates the structure of a control section and that of a recording head according to a second embodiment of the present invention.

FIG. 11 illustrates a second embodiment of the present invention having an arrangement that the quantity P (p1) of discharged ink from each nozzle of the recording head 10 is controlled in accordance with the type of the cloth. As shown in FIG. 12, the second embodiment is arranged in such a manner that the recording head 10 has a head heater 501 for raising the temperature of the recording head 10 and a thermistor 502 for detecting the temperature of the recording head 10 so that the quantity P (p1) of discharged ink from each nozzle of the recording head 10 is controlled. In accordance with the type of the cloth, the state where the recording head 10 is heated by the head he after 501 is controlled at the time of the recording operation so that the ink discharge quantity P from each nozzle of the recording head 10 is controlled. If an image is recorded on the cloth A at the aforesaid low density, the temperature T of the recording head 10 is set to a high temperature $T_A$ ($T_A>T_B$: $T_B$ is the temperature of the head with respect to the cloth B to which an image is recorded at the afore said high density) so as t o increase the ink droplet quantity $P_A$ ($P_A>P_B$: $P_B$ is the quantity of ink to be discharged at temperature $T_B$) to be discharged from the recording head 10.

Figure 13:
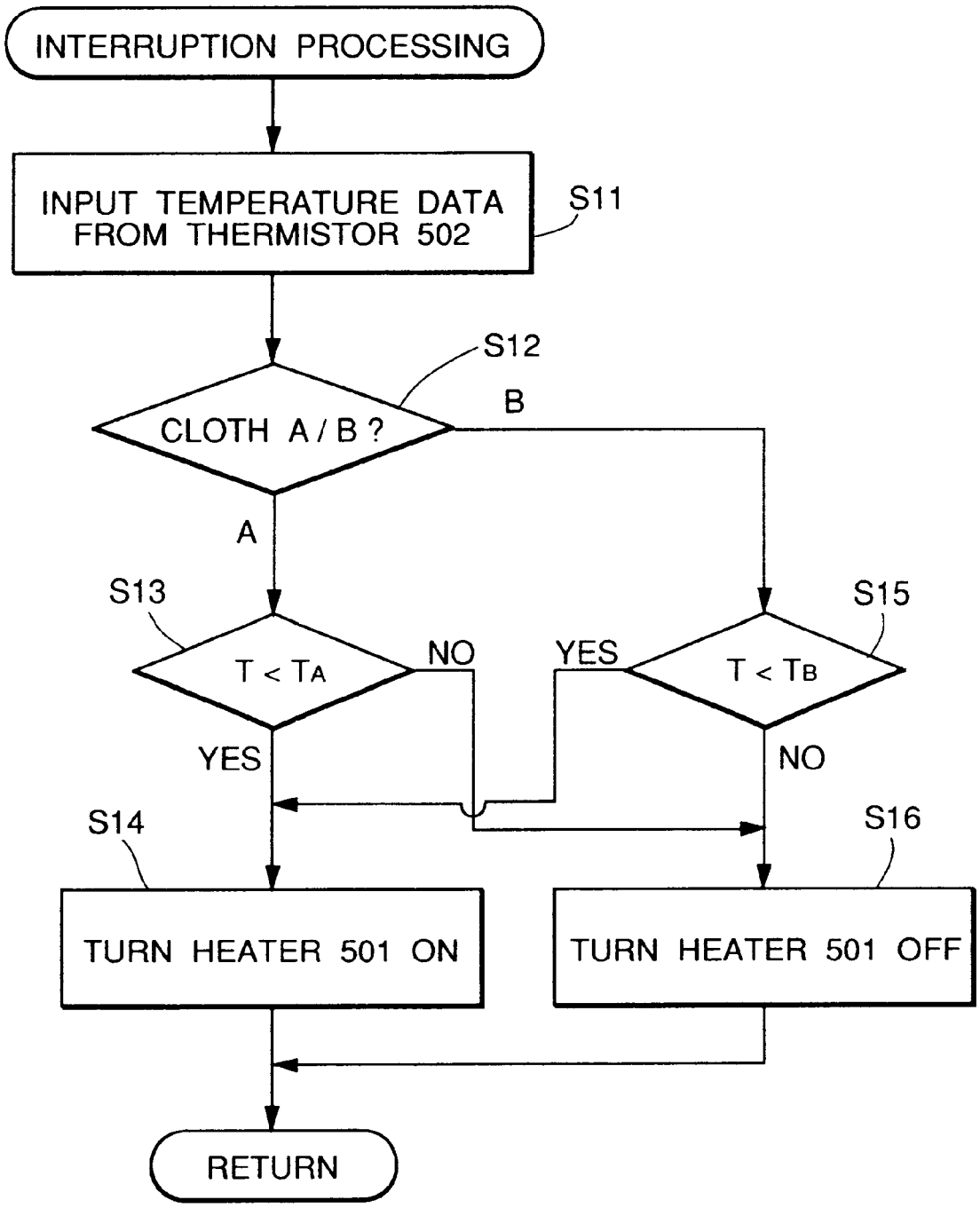
FIG. 13 is a flow chart which illustrates a temperature control operation according to the second embodiment of the present invention.

The aforesaid process is described in a flow chart shown in FIG. 13. The aforesaid process is commenced when a timer interruption is made at a predetermined time interval (for example, 100 ms) generated by a timer (omitted from illustration) provided for the control section 9. In step 11, temperature information supplied from the thermistor 502 is inputted, and the type of the set cloth is discriminated in step S12. If a discrimination is made that the cloth is the cloth A, the flow proceeds to step S13 in which whether or not the head temperature at this time is $T_A$ or lower is discriminated. If the temperature is $T_A$ or lower, the f low proceeds to step S14 in which the heater 501 is turned on. If the temperature is $T_A$ or higher, the flow proceeds to step S16 in which the heater 501 is turned off. If the cloth is the cloth B, the flow similarly proceeds to step S15 in which the head temperature T is subjected to a comparison with temperature $T_B$. If the temperature is $T_B$ or lower, the heater 501 is turned on in step S14. If the temperature is $T_B$ or higher, the heater 501 is turned off in step S16.

<Third Embodiment>

Figure 14:
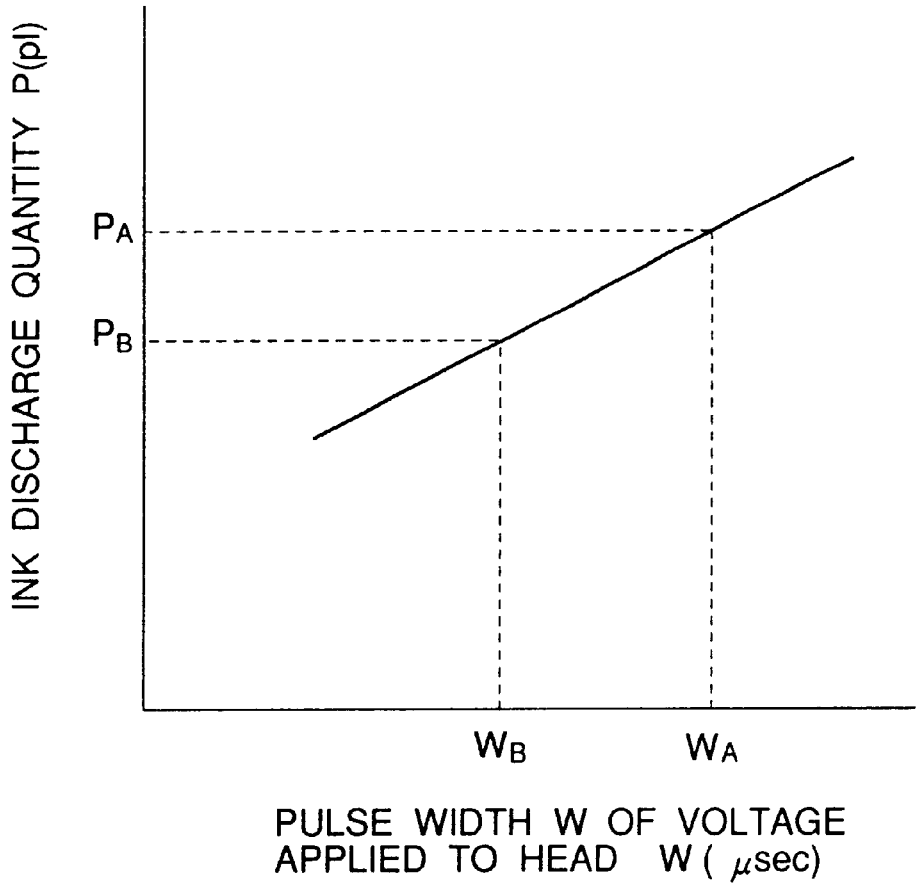
FIG. 14 is a graph which illustrates the relationship between the Widths of the pulses applied to the recording head and the quantities of discharged ink.

FIG. 14 illustrates a third embodiment of the present invention having an arrangement that the ink discharge quantity P from each nozzle of the recording head 10 is controlled in accordance with the type of the cloth.

Figure 15:
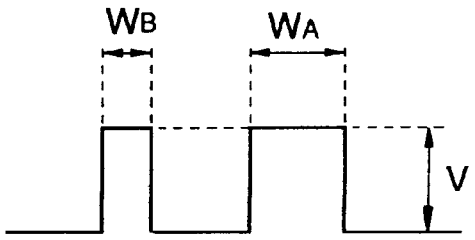
FIG. 15 illustrates a pulse signal to be applied to a recording head according to a fourth embodiment of the present invention.

The third embodiment has an arrangement that the ink discharge quantity P from each nozzle of the recording head 10 is controlled by controlling the width W ($\mu$sec) of the pulse signal to be supplied to the electricity-to-heat converter 22 (see FIG. 3) of the recording head 10. For example, if the cloth A on which an image is recorded at the low density, the pulse width W is set to a large width $W_A$ ($W_A>W_B$: $W_B$ is the pulse width adapted to the cloth B on which an image is recorded at the high density) so that the ink droplet quantity $P_A$ to be discharged from the recording head 10 is increased ($P_A>P_B$: $P_B$ is the ink droplet quantity to be discharged when the pulse width is $W_B$). FIG. 15 illustrates pulse signals respectively having widths of $W_A$ and $W_B$.

<Fourth Embodiment>

Figure 16:
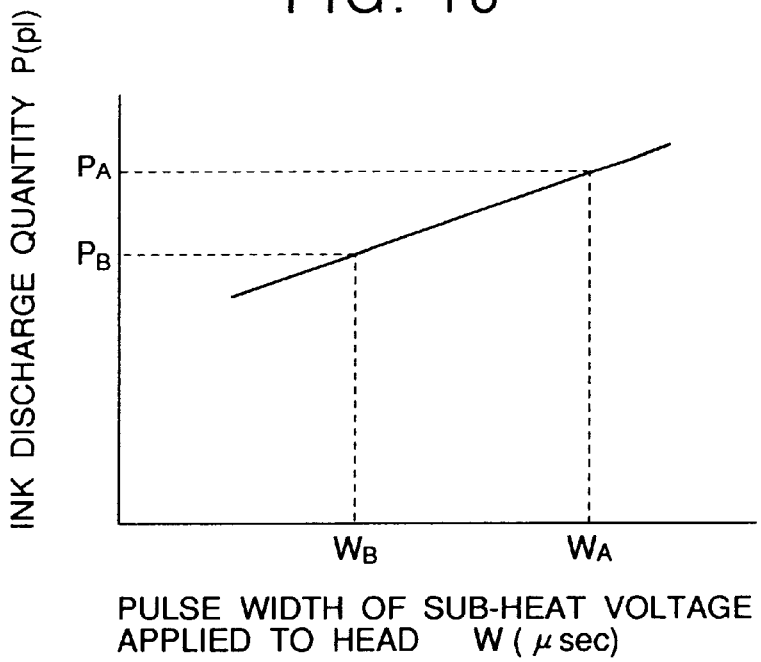
FIG. 16 is a graph which illustrates the relationship between the quantities of ink discharged from the recording head and the quantity of discharged ink realized according to the fourth embodiment of the present invention.

FIG. 16 illustrates a fourth embodiment of the present invention having an arrangement that the quantity P of ink to be discharged from each nozzle of the recording head 10 is controlled in accordance with the type of the cloth. The fourth embodiment has an arrangement that the quantity P of ink to be discharged from each nozzle of the recording head 10 is controlled by applying pulse voltage to the electricity-to-heat converter 22 of each nozzle of the recording head 10, the pulse voltage being composed of the two pulse signals similar to those shown in FIG. 15.

A first pulse voltage to be first applied to the electricity-to-heat converter 22 and having pulse width w ($W_B$ in FIG. 15) with which energy causing no bubble forming phenomenon of ink to take place on the surface of the electricity-to-heat converter 22 is applied. Ink on the electricity-to-heat converter 22 is heated by the first pulse voltage serving as the sub-heat pulse so that the temperature of the ink is raised. Then, a second pulse voltage having width of W ($W_A$ in FIG. 15) (W>w) is applied to the electricity-to-heat converter 22 so as to cause the ink to form bubbles. As a result, an ink droplet is discharged from the recording head 10o By controlling the first pulse voltage width w serving as the sub-heat pulse, the temperature of the ink present on the surface of the electricity-to-heat converter 22 can be controlled. Consequently, the quantity of the ink droplet to be discharged from each nozzle when the second pulse voltage is applied can be controlled. Furthermore, the ink quantity P of the ink droplet discharged from each nozzle of the recording head 10 can be widely varied by controlling both the pulse width W of the second pulse voltage which causes the bubble forming phenomenon to take place and the pulse width w of the first pulse voltage. Therefore, an image can be recorded on further various types of cloths.

The operations to be performed in this embodiment can be performed similarly to the aforesaid embodiments. That is, the width of the pulse voltage to be applied to the recording head 10 in accordance with the type of the cloth is controlled in steps S4 and S5 of the flow chart shown in FIG. 9.

<Fifth Embodiment>

Figure 17:
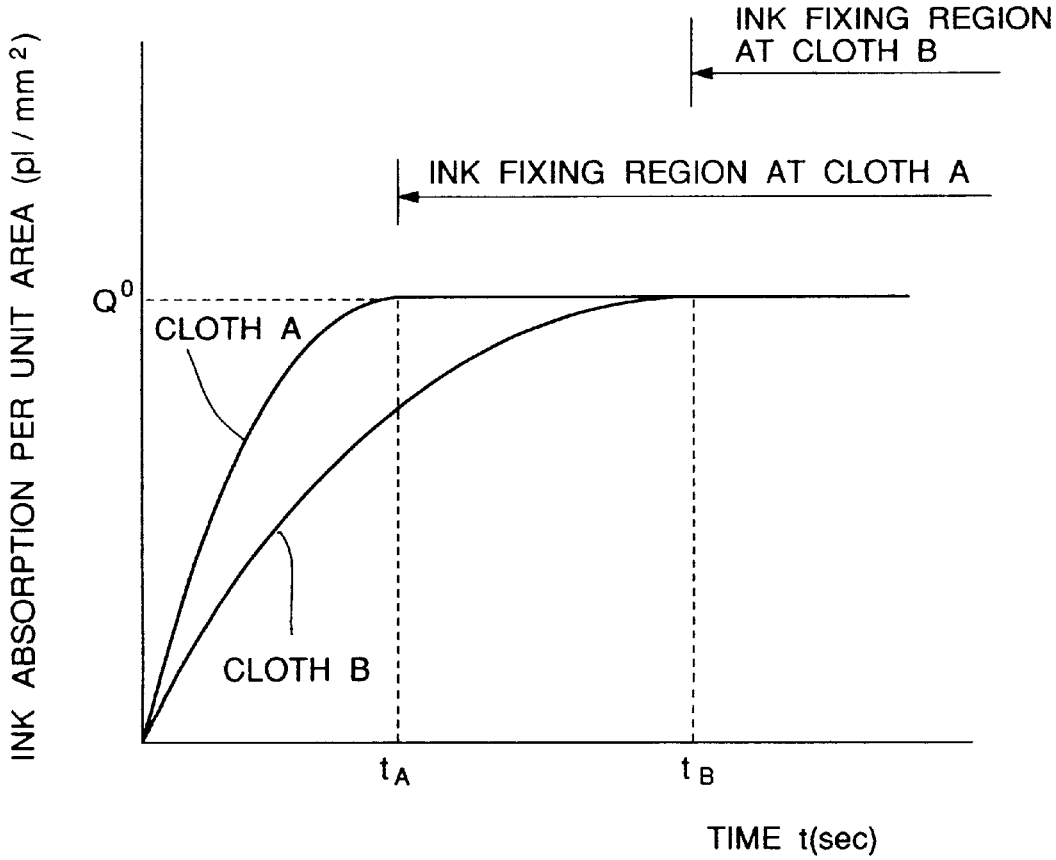
FIG. 17 illustrates the time taken for ink to be fixed depending upon the cloths in which ink is absorbed in different manners according to a fifth embodiment of the present invention.
Figure 18:
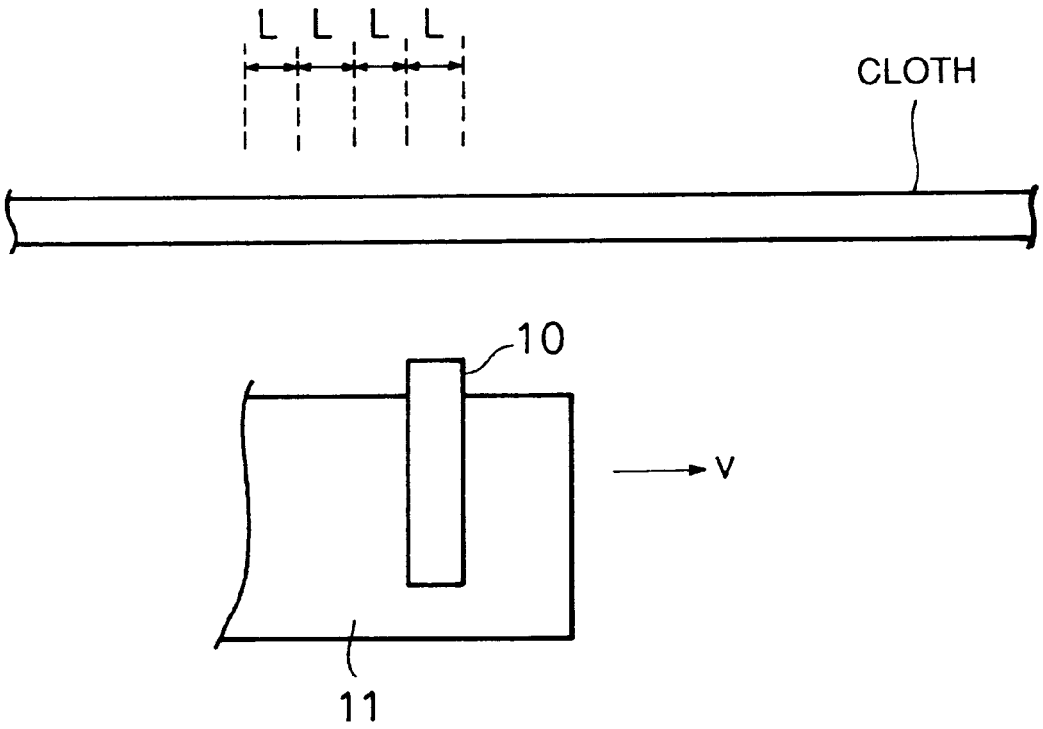
FIG. 18 illustrates an example of control of the quantity of ink to be discharged from a recording head according to a fifth embodiment of the present invention.

A fifth embodiment of the present invention will now be described. If the type of the cloth, for example, the diameter of the fiber, the weaving pitch or the thickness of the cloth, is different at the time of recording image data on the cloth, the manner in which the ink droplet discharged from the recording head 10 is absorbed becomes different. For example, a difference lies in the time sequential change characteristics of the quantity Q ($p1/mm^2$) of ink which can be absorbed per unit area between the aforesaid cloths A and B shown in FIGS. 6A and 6B. As shown in FIG. 17, the time taken for ink of a quantity of $Q_0$ ($p1/mm^2$) per unit area required to record the overall area at a recording density of, for example, 400 dpi to be absorbed by the cloth is $t_A$ seconds or longer if the cloth A is recorded. If an image is recorded on the cloth B which cannot absorb ink satisfactorily, time $t_B$ ($t_A<t_B$) is required. Even if the image is recorded on the cloth A at an allowable speed, ink discharged from the recording head 10 cannot be absorbed by the cloth B and ink overflows in the cloth B in the case where the image is recorded on the cloth B at the same recording speed. Therefore, the recorded image bleeds or the formed dots are connected successively, causing the quality of the formed image to deteriorate.

Accordingly, the fifth embodiment is so constituted as to enable high quality recorded images to be equally obtained on various types of cloths having different ink absorption rates by employing an arrangement that the quantity of recording ink to be discharged on the cloth from the recording head 10 per unit area or unit time is, as the condition of the recording operation to be performed by the recording head 10, controlled. As a result, the ink jet recording head records an image under the optimum conditions for the subject cloth.

That is, the scanning speed v (mm/sec) of the carriage 11 on which the recording head 10 is mounted is $v=L\cdot F$ (mm/s) assuming that the ink droplet discharge frequency from the recording head 10 is F (Hz) and the recorded pixel pitch on the cloth is L (mm) (L=63.5 mm when the density of the recorded pixel is 400 dpi). In order to control the quantity of recording ink to be discharged on the cloth from the recording head 10 per unit area or unit time to be suitable for the type of the cloths having different ink absorptions, this embodiment has an arrangement that the operation frequency F (Hz) of the recording head 10 is controlled in accordance with the type of the cloth. As a result, the quantities of recording ink to be discharged to the cloths having different ink absorptions from the recording head 10 per unit area or unit time are controlled.

That is, it is necessary for the image to be recorded by the recording head 10 at a time interval of $T_A$ ($T_A \geqq t_A$) which is longer than the ink absorption time $t_A$ (sec) taken for the image to be recorded on the cloth A if an image is recorded on the cloth A exhibiting a relatively excellent ink absorption at the recording pixel pitch of L (mm). Hence, the recording head 10 is operated at an operation frequency of $F_A$ ($=1/T_A$) (Hz). Furthermore, the speed $V_A$, at which the carriage 11 is scanned in the main scanning direction, is made to be $L\cdot F_A$ to record the image on the cloth A.

If an image is recorded on the cloth B having inferior ink absorption to that of the cloth A, it is necessary for the image to be recorded by the recording head 10 at a time interval of $T_B$ ($T_B>t_B>t_A$) which is longer than the ink absorption time $t_B$ (sec) taken for the image to be recorded on the cloth B. Hence, the recording head 10 is operated at operation frequency of $F_B$ ($=1/T_B$). Furthermore, the speed $V_B$, at which the carriage 11 is scanned in the main scanning direction, is made to be $L\cdot F_B$ to record the image on the cloth B. As a result, an image can be recorded on the cloths A and B having different ink absorptions under the optimum conditions so that an excellent quality image can be recorded. Since the aforesaid operation can be performed by determining the scanning speed to be adaptable to the type of the subject cloth at the time of the commencement of the scanning operation performed by the carriage 11 in step S1 in the flow chart shown in FIG. 10 and by changing the condition for operating the recording head 10 to be adaptable to the type of the cloth in steps S3 to S5, the description of a flow chart of the operations according to this embodiment is omitted.

<Sixth Embodiment>

Figure 19:
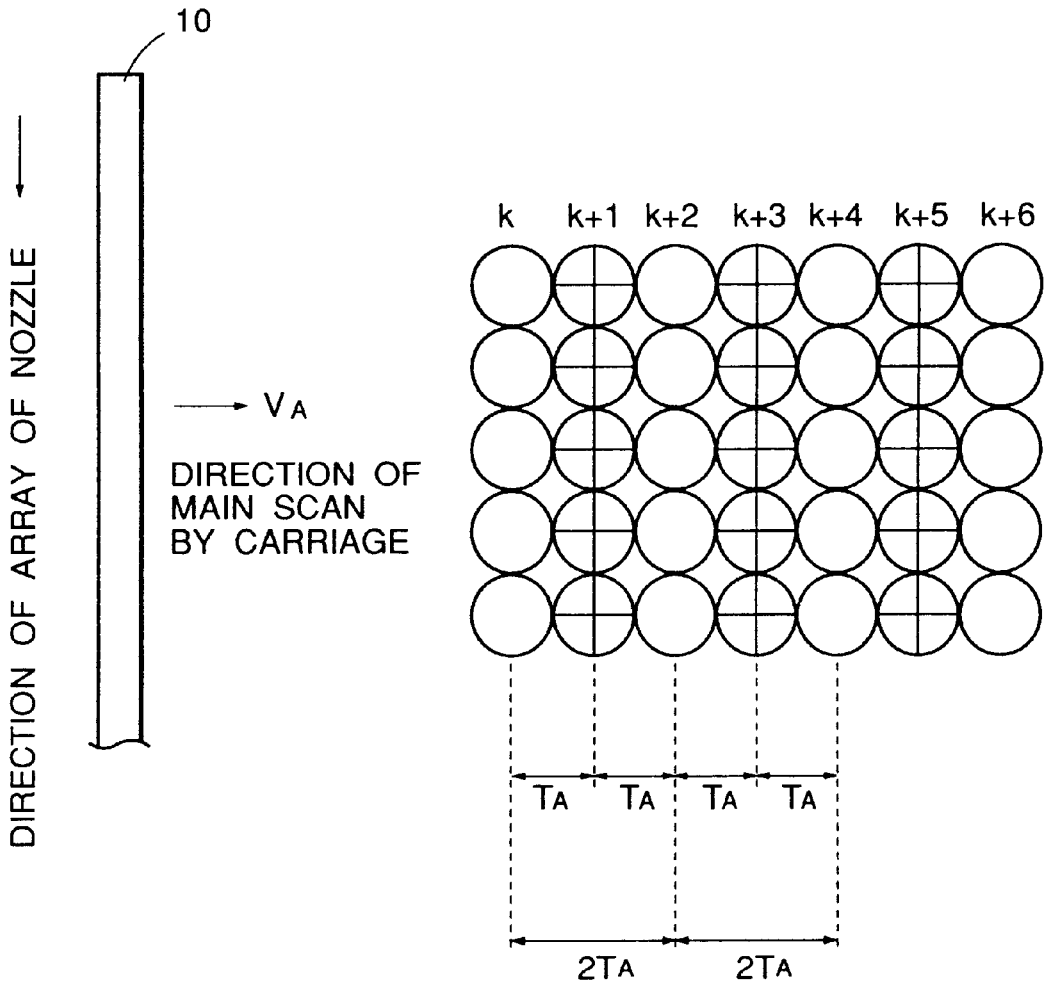
FIG. 19 illustrates an example of a recording operation in which recording to be performed by a recording head is divided into plural scans per recording line according to a sixth embodiment of the preset invention.

FIG. 19 illustrates a sixth embodiment of the present invention having an arrangement that high quality recorded images can be equally obtained on various types of cloths having different ink absorptions by controlling the quantity of recording ink to be discharged to the cloth from the recording head 10 per unit area or unit time as the condition o f the recording operation to be performed by the recording head 10. In order to control the quantity, the number of times of the main-scanning directional scanning operations performed by the carriage 11 on which the recording head 10 is mounted is controlled, so that the operation of recording an image on the cloth by the recording head 10 is divided into plural scans per recording line.

If an image is recorded on the cloth B having poor ink absorption in comparison to that of the cloth A by a method similarly t o t hat performed for the cloth A, adjacent pixels are sometimes undesirably connected to each other or ink sometimes overflows. Accordingly, this embodiment has an arrangement that the image recording operation to be performed by the recording head 10 is divided into two scans if the cloth B of a type, the ink absorption time ts of which holds a relationship $T_A<t_B\leqq 2T_A$, is used. That is, pixel columns k, k+2, k+4, . . . are recorded by a first main scanning operation while scanning the carriage 11 at scanning speed $V_A$. Then, residual pixel columns k+1, k+3, k+5, . . . are recorded by a second main scanning operation. By recording the image on the cloth B at the interval of $2T_A$ ($\leqq t_B$) which is longer than the ink absorption time tB realized in the case of the cloth B, the problem of the overflow of the recording ink droplet on the cloth B and other problems can be overcome while eliminating the necessity of changing the scanning speed of the carriage 11 in the main scanning direction.

If an image is recorded on a cloth displaying further poor ink absorption than that of the cloth B, the recording operation to be performed by the recording head 10 is divided into three or more scans per recording line. Hence, an image can be recorded on a cloth while maintaining excellent quality regardless of the ink absorption characteristics of the subject cloth in such a manner that a necessity of changing the moving speed of the carriage 11 can be eliminated.

<Seventh Embodiment>

FIG. 20 illustrates a seventh embodiment of the present invention having an arrangement that the quantity of recording ink to be discharged on the cloth from the recording head 10 per unit area or unit time is controlled in accordance with the type of the cloth.

This embodiment has an arrangement that a plurality of recording heads 10$_B$, 10$_c$, . . . are mounted on the carriage 11 so as to be capable of recording an image on a cloth even if the ink absorption is different. At this time, the intervals of a plurality of the recording heads are controlled in order to control the timing of recording on the same pixel on the cloth by the recording head.

Figure 20A:
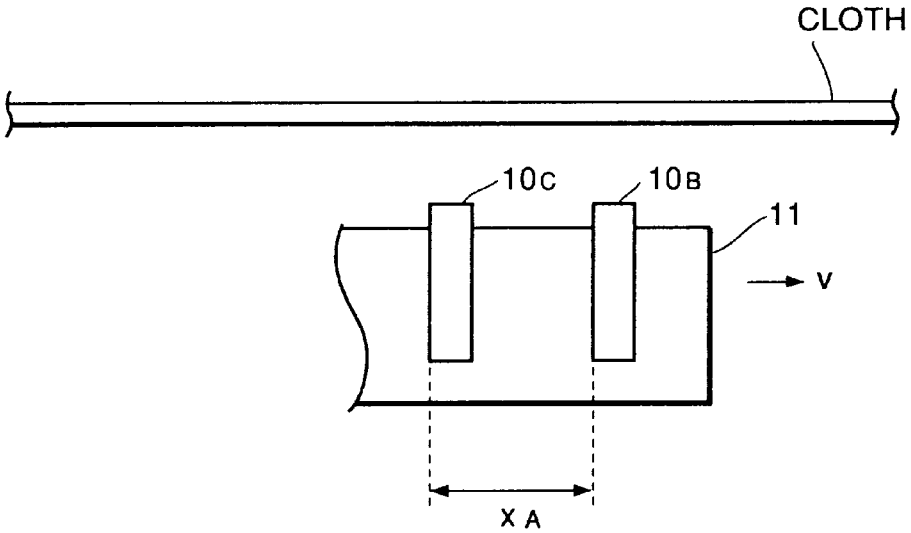
FIGS. 20(A) and 20(B) illustrate examples of a recording operation performed by a plurality of recording heads according to a seventh embodiment of the present invention.

If an image is recorded on the cloth A displaying excellent ink absorption by a plurality of the recording heads 10$_B$, 10$_c$, . . . separated by a distance $x_A$ as shown in FIG. 20A, it is necessary for the time interval from a moment the ink droplet is supplied to the cloth A from the first recording head 10B to a moment an ink droplet is supplied by the second recording head 10C meets a relationship expressed by $\Delta T_A\leqq t_1=x_A/v$ assuming that the time taken for an ink droplet supplied to the cloth B by the first recording head 10$_B$ to be absorbed before an ink droplet is supplied by the second recording head 10C is $\Delta T_A$ (sec). Here, the main scanning directional scanning speed of the carriage, on which the recording heads 10$_B$, 10$_c$, . . . are mounted, is assumed to be v (mm/sec).

Figure 20B:
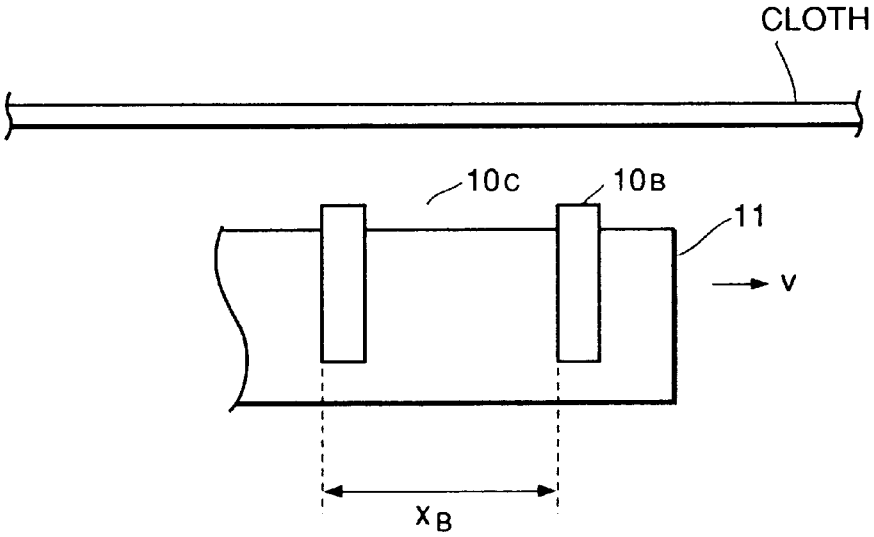

When an image is recorded on the cloth B having further poor ink absorption in comparison to the cloth A by a plurality of the recording heads 10$_B$, 10$_c$, . . . as shown in FIG. 20B, a relationship $\Delta T_B>\Delta T_A$ is held assuming that the time taken for an ink droplet to be absorbed from a moment the ink droplet is discharged to the cloth B by the first recording head 10$_B$ to a moment an ink droplet is discharged from the second recording head 10C is $\Delta T_B$ (sec). Therefore, it is necessary for the distance $x_B$ (mm) ($x_B>x_A$) between the recording heads 10B and 10C to be so determined that time difference $t_2$ (sec) taken from a moment an image is recorded on the same pixel of the cloth B by the recording head 10$_B$ to a moment an image is recorded by the recording head 10$_C$ holds a relationship $\Delta T_B\leqq t_2=X_B/V$.

As a method of changing the distance x (mm) among a plurality of the recording heads 10$_B$, 10$_c$, . . . , an arrangement may be employed in which places to which the recording heads 10 are disposed are provided by a number larger than the number of the recording heads utilized so as to be changed by a user in accordance with the type of the cloth so that the distance between the heads is changed. Another arrangement may be employed in which a rail or the like is disposed on the cartridge 11 so as to enable each recording head to slide on the rail in the main scanning direction of the carriage. Furthermore, the control portion 9 may cause each recording head to slide on the rail by a motor or the like in response to a signal indicating the type of the cloth so that the distance among the recording heads is adjusted.

<Eighth Embodiment>

Figure 21:
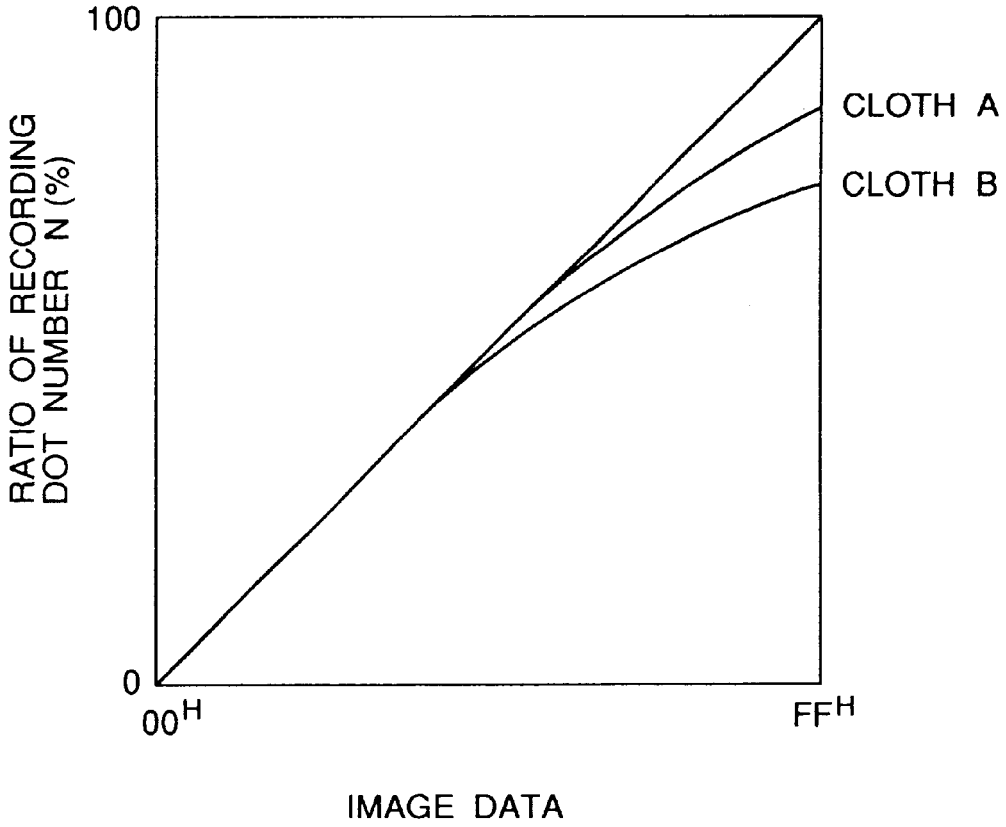
FIG. 21 is a graph which illustrates the relationship between a recording dot ratio and the recording density depending upon the type of the cloth realized by the recording head according to an eighth embodiment of the present invention.

FIG. 21 illustrates an eighth embodiment of the present invention having an arrangement that the quantity of recording ink to be discharged to the cloth from the recording head 10 per unit area or unit time is controlled in accordance with the type of the cloth. The eighth embodiment has an arrangement that the number of ink droplets to be discharged from the recording head 10 is restricted when using a cloth having a poor ink absorption so that an overflow of the ink on the cloth is prevented.

That is, the fact that ink cannot be absorbed by the cloth B having poor ink absorption takes place excessively if the quantity of the image data is great and in a region in which the ratio N (%) of the number of dots actually recorded to the number of dots required to be recorded by the recording head approximates 100%. Accordingly, this embodiment has an arrangement that the ratio N (%) of the number of the dots to actually be recorded is lowered with respect to image data if an image is recorded on the cloth B having poor ink absorption in order to prevent the overflow of the ink on the cloth B. According to this embodiment, the image processing section 2 is provided with a ROM in which a plurality of tables for converting the ratio N of the image data and dots to be recorded are stored so that a ROM table is selected by the control section 9 in accordance with the type of the cloth. As a result, the optimum maximum quantity of ink to be discharged onto each cloth is selected.

As described above, according to the present invention, the necessity of using the screen stencil for use in the screen printing operation can be eliminated by directly printing an image on a cloth by employing the ink jet recording method in which small ink droplets are discharged to record an image. Therefore, the manufacturing time required until the image is printed on the cloth can be significantly reduced. Furthermore, the size of the apparatus can be reduced and an image can be recorded on a variety of cloths while maintaining satisfactory quality.

<Ninth Embodiment>

Figure 22A:
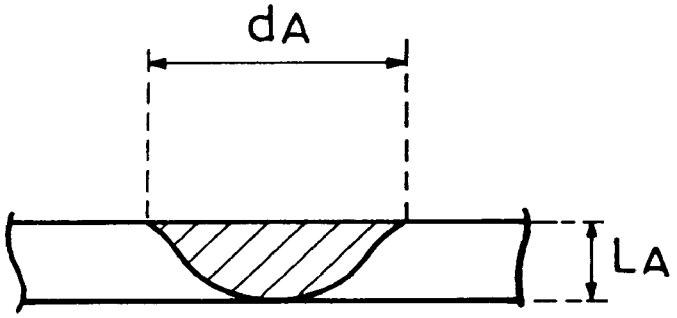
FIGS. 22(A) and 22(B) illustrate states where ink is absorbed depending upon the thickness of the cloth as realized according to a ninth embodiment of the present invention.
Figure 22B:
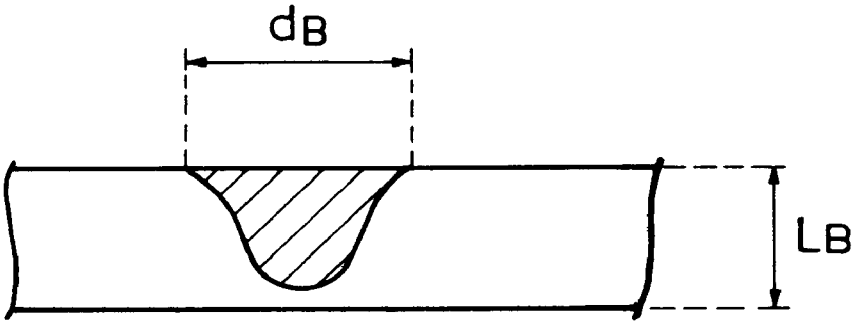

A ninth embodiment will now be described. When image data is recorded on a cloth, the state where the ink droplet discharged from the recording head 10 is absorbed by the cloth is different depending upon the diameter of the fiber, the weaving pitch, the thickness of the cloth and the type of the cloth. Therefore, the diameter $d_B$ of a dot recorded on the cloth B having thickness $L_B$ ($L_A<L_B$) is small in comparison to diameter $d_A$ of the dot recorded on the cloth A having, for example, $L_A$ as shown in FIGS. 22A and 22B because the recorded ink droplet can easily be absorbed in the direction of the thickness of the cloth B.

Figure 23:
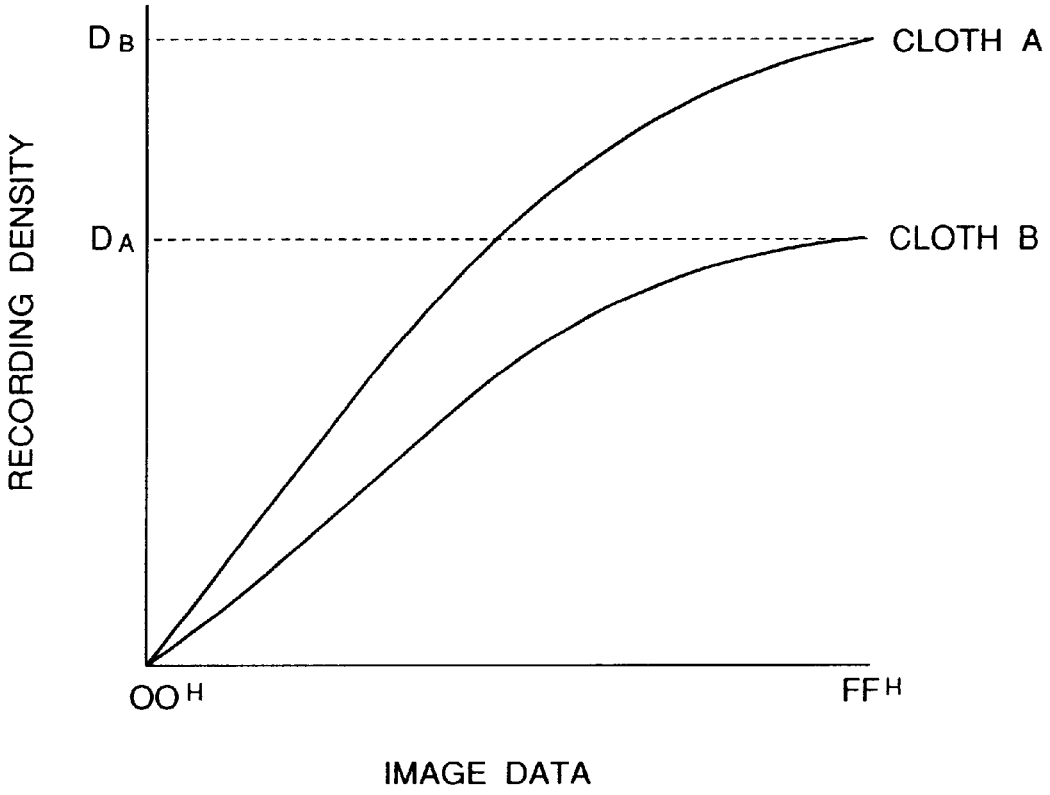
FIG. 23 is a graph which illustrates states where ink is absorbed depending upon the thickness of the cloth according to a ninth embodiment of the present invention.

As a result, the density of the recorded image is different between the cloths A and B as shown in FIG. 23 even if the same image data is recorded. Furthermore, the fact that the diameters of the recorded dots are different between the cloths A and B causes the sharpness of the recorded image to be different. As a result, the qualities of the recorded images are different from each other considerably. What is worse, the ink recorded by the recording head 10 cannot be absorbed by the cloth depending upon the type of the cloth, causing the problem of the overflow to arise.

Accordingly, the ninth embodiment of the present invention has an arrangement that the type of the cloth is automatically detected or the type of the cloth is instructed by a user by using a change-over switch so that the recording conditions are changed over to record an image under the optimum recording conditions.

Figure 24A:
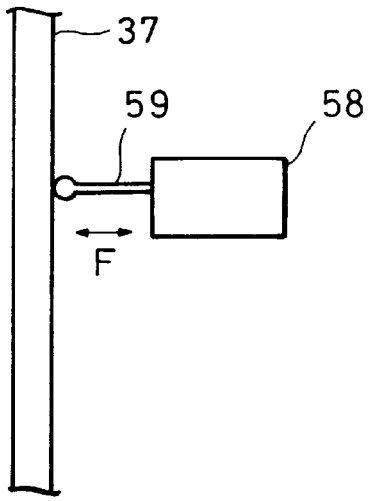
FIGS. 24(A) and 24(B) illustrate states where the thickness of the oth is detected according to the ninth embodiment of the present invention.
Figure 24B:
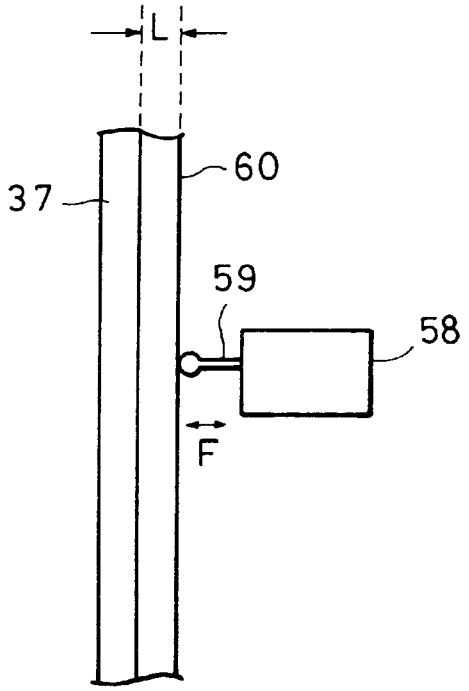

FIG. 24 illustrates a contact sensor 58 serving as a cloth type detection means disposed to be in contact with the conveyance belt 37 downstream of the pressing roller 40 in order to detect the thickness of the cloth. As shown in FIG. 24A, the contact sensor 58 has a contact pin 59 movable in a direction designated by an arrow F. The contact pin 59 is brought into contact with the conveyance belt 37, and then a cloth 60 (having thickness L) is conveyed to the upper surface of the conveyance belt 37 as shown in FIG. 24B. By bringing the contact pin 59 into contact with the cloth 60 placed on the conveyance belt 37 as described above, the thickness L of the cloth 60 is measured.

This embodiment has an arrangement that the ink droplet quantity P discharged from each nozzle of the recording head 10 is controlled as the conditions of the recording operation performed by the recording head 10 in accordance with the thickness L of the cloth 60. That is, a pulse signal having a voltage of V and a pulse width of W ($\mu$s) as shown in FIG. 8 is applied to the electricity-to-heat converter 22 of each nozzle of the ink jet recording head 10 according to the present invention and arranged as shown in FIG. 3 from which an ink droplet is discharged. As a result, the ink droplet is discharged from each nozzle due to the bubble forming phenomenon that takes place on the electricity-to-heat converter 22.

Figure 25:
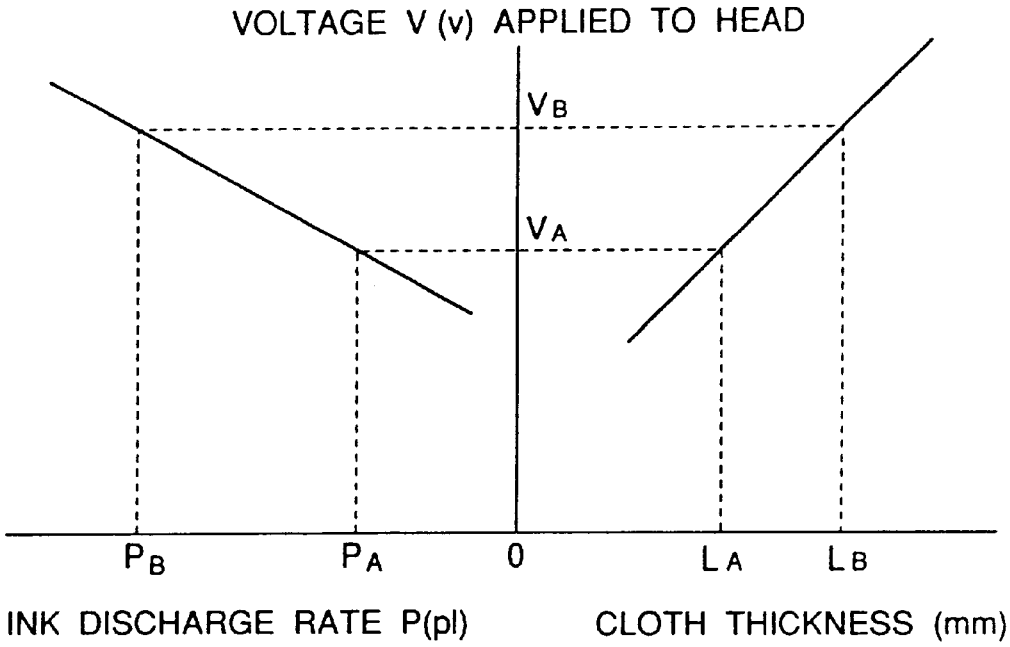
FIG. 25 is a graph which illustrates the relationship among the, thickness of the cloth, the voltage applied to the head and the quantity of discharged ink realized according to the ninth eibodiment of the present invention.

By raising the voltage level V of the pulse signal to be applied to the electricity-to-heat converter 22 of the recording head 10, the ink quantity (P) to be discharged from each nozzle of the recording head 10 can be increased as shown in FIG. 25. Therefore, the voltage level V of the pulse signal to be applied to the electricity-to-heat converter 22 of the recording head 10 is changed over in accordance with the thickness of the subject cloth in such a manner that the pulse voltage $V_B$ is set ($V_B>V_A$) if an image is recorded on the thick cloth B as shown in FIG. 22. As a result, the quantity of ink to be discharged from the recording head 10 is increased to $P_B$ ($P_B>P_A$). If an image is recorded on the thin cloth A as shown in FIG. 22, the pulse voltage $V_A$ is set to a low level ($V_A<V_B$) so that the quantity of ink to be discharged from the recording head 10 is set to $P_A$ ($P_A<P_B$). By recording an image with the optimum ink droplet for the thickness of the subject cloth as described above, the problems of the deterioration of quality of the recorded image and the overflow of ink can be overcome and an image can be recorded with the optimum dot diameter.

<Tenth Embodiment>

Figure 26:
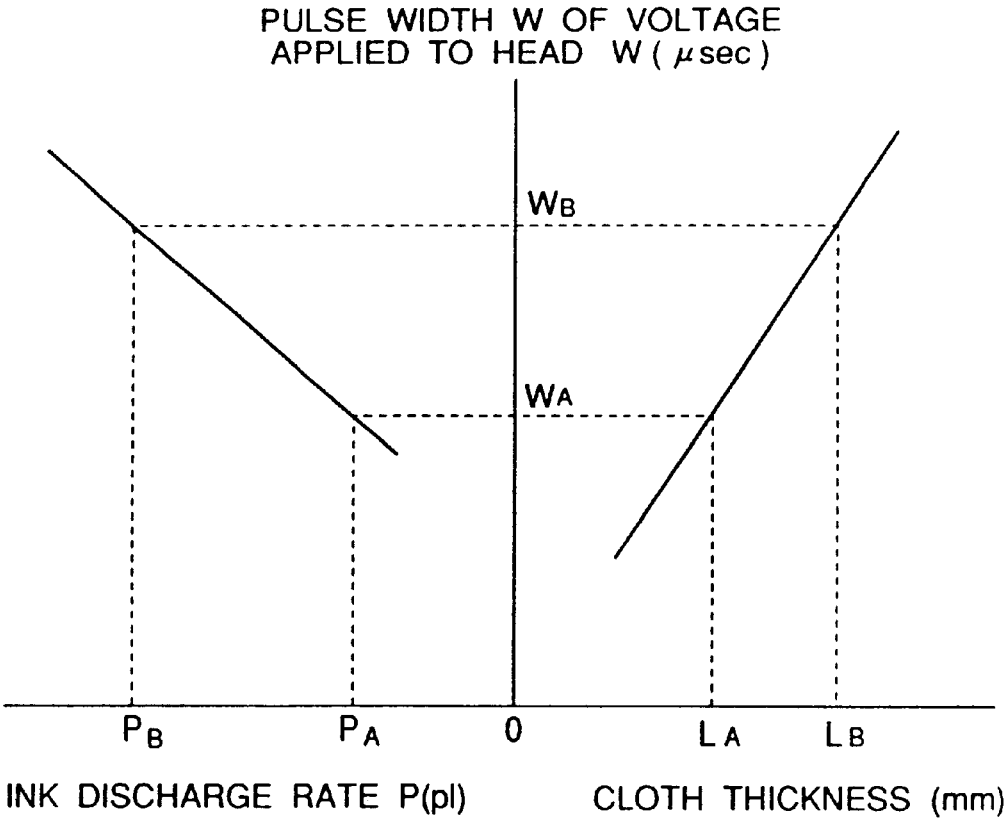
FIG. 26 is a graph which illustrates the relationship among the thickness of the cloth, the width of the pulse applied to the head and the quantity of discharged ink realized according to a tenth embodiment of the present invention.

FIG. 26 illustrates a tenth embodiment having an arrangement that the ink discharge quantity P (p1) from each nozzle of the recording head 10 is controlled in accordance with the thickness of the cloth. This embodiment has an arrangement that the ink discharge quantity P is controlled by controlling the pulse width ($\mu$sec) of the pulse signal to be supplied to the electricity-to-heat converter 22 of each nozzle of the recording head 10. If an image is recorded on the thick cloth B as shown in FIG. 22, the pulse width W is set to a large width $W_B$ ($W_B>W_A$: $W_A$ is the pulse width for use when an image is recorded on the thin cloth A) so that the quantity $P_B$ of the ink droplet to be discharged from the recording head 10 is increased ($P_B>P_A$: $P_A$ is the ink discharge quantity employed when the pulse width is $W_A$).

<Eleventh Embodiment>

Figure 27:
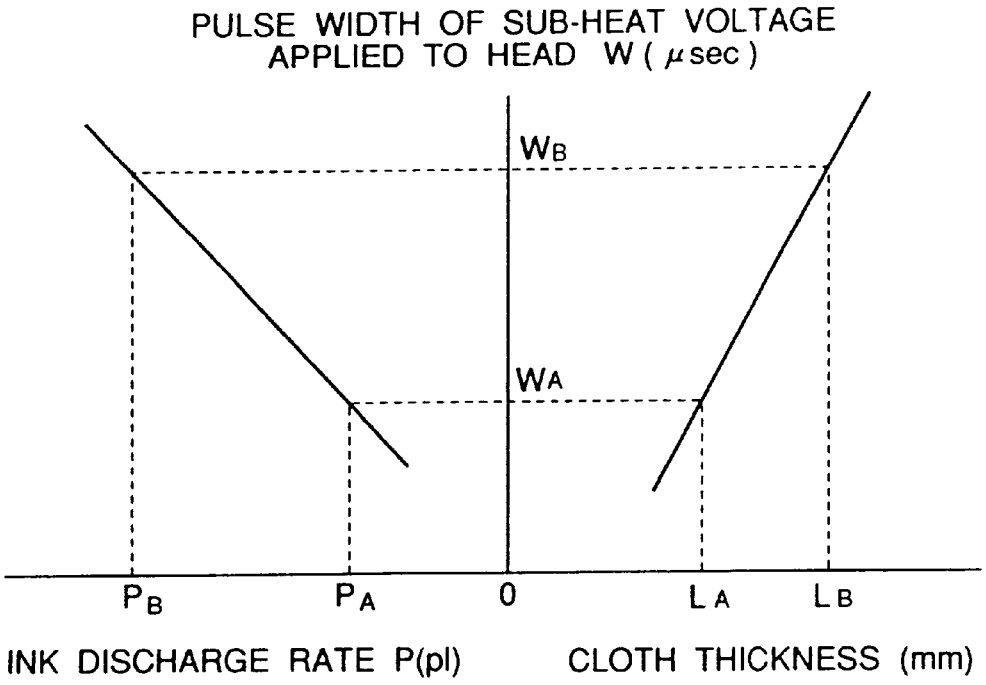
FIG. 27 is a graph which illustrates the relationship among the thickness of the cloth, the width of the sub-heat pulse applied to the head and the quantity of discharged ink realized according to an eleventh embodiment of the present invention.

FIG. 27 illustrates an eleventh embodiment having an arrangement that the quantity of ink to be discharged from each nozzle of the recording head is controlled in accordance with the thickness of the cloth. This embodiment has an arrangement that pulse voltage composed of two pulse signals as shown in FIG. 15 is applied. Among the pulse voltages, a first pulse voltage to be first applied to the electricity-to-heat converter 22 has pulse width w with which energy which does not cause the bubble forming phenomenon of ink to take place on the surface of the electricity-to-heat converter 22 is applied. Ink is heated by the first pulse, and then a pulse voltage having width of W (W>w) is applied to the electricity-to-heat converter 22 so as to cause the ink to form bubbles. As a result, an ink droplet is discharged from the recording head 10. By controlling the first pulse voltage width w serving as the sub-heat pulse, the temperature of the ink present on the surface of the electricity-to-heat converter 22 can be controlled. Furthermore, the quantity of the ink droplet to be discharged from each nozzle can be increased/decreased when the second pulse voltage is applied. By controlling the pulse width W of the second pulse voltage which causes the bubble forming phenomenon to take place and the pulse width w of the first pulse voltage, the ink quantity the ink discharged from the recording head 10 can be widely varied. As a result, the recording operation can be widely controlled in accordance with the thickness of the cloth.

<Twelfth Embodiment>

Figure 28:
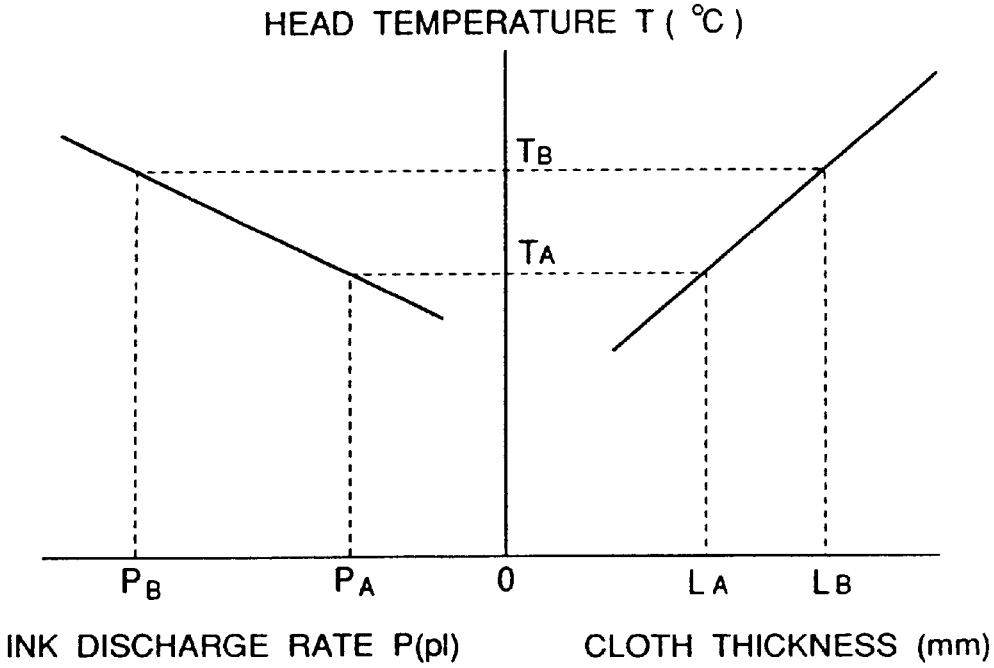
FIG. 28 is a graph which illustrates the thickness of the cloth, the temperature of the recording head and the quantity of discharged ink realized according to a twelfth embodiment of the present invention.

FIG. 28 illustrates a twelfth embodiment of the present invention having an arrangement that the quantity P (p1) of ink to be discharged from each nozzle of the recording head 10 is controlled in accordance with the thickness of the cloth.

In order to control the quantity P (p1) of ink to be discharged from each nozzle of the recording head 10 as shown in FIG. 12, a heater 501 serving as a head heating means for raising the temperature of the recording head 10 and a thermistor 502 for detecting the temperature of the recording head 10 are provided. In accordance with the type of the cloth, the state where the recording head 10 is heated by the heater 501 is controlled so that the temperature of the recording head 10 at the time of the recording operation is controlled. If an image is recorded on the thick cloth B, the temperature T of the recording head 10 is set to a high level $T_B$ ($T_B>T_A$) so that the quantity $P_B$ of ink to be discharged from the recording head 10 is increased.

<Thirteenth Embodiment>

Figure 29:
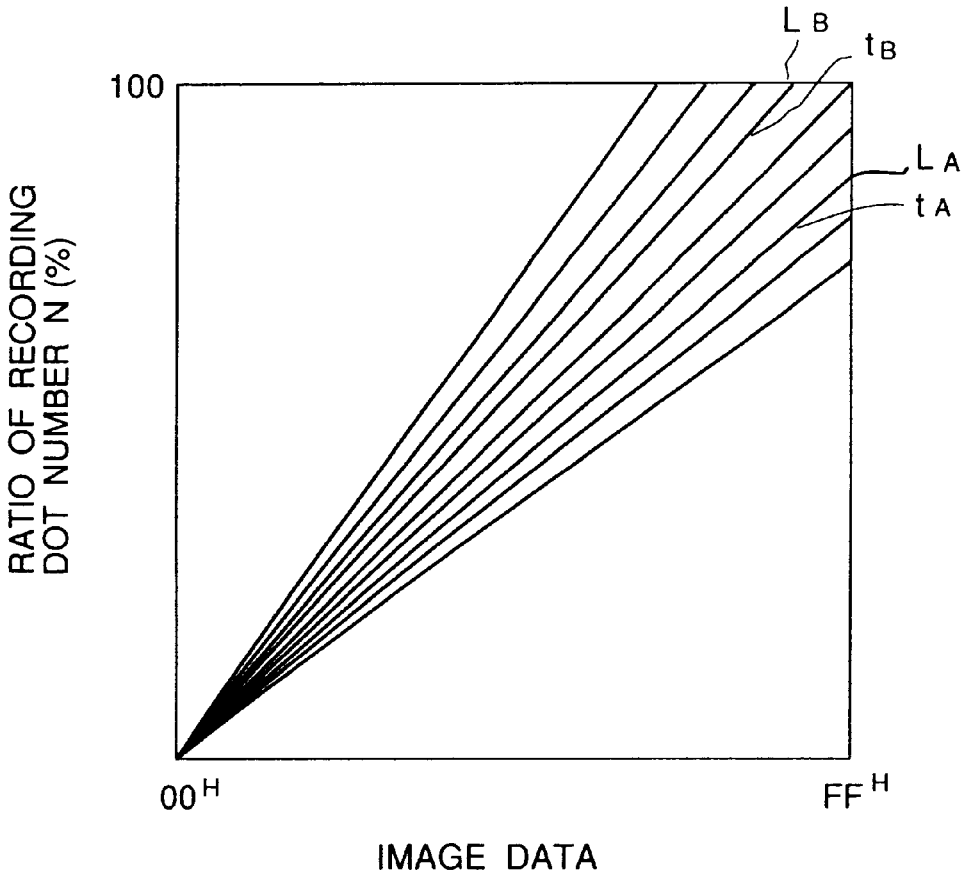
FIG. 29 is a graph which illustrates the thickness of the cloth, the recording dot ratio and the density of the recorded image realized according to a thirteenth embodiment of the present invention.

FIG. 29 illustrates a thirteenth embodiment of the present invention having an arrangement that the quantity of ink to be discharged from the recording head 10 is controlled in accordance with the thickness of the cloth.

If an image is recorded on a thin cloth, the diameter of the dot recorded on the cloth is small as described above. Therefore, the table $t_B$ which is arranged as shown in FIG. 29 and with which the ratio N of the number of dots to be recorded with respect to image data is increased is selected so that the number of ink droplets to be recorded on the cloth B is increased if an image is recorded on the thick cloth B as shown in FIG. 22. If an image is recorded on the thin cloth A (see FIG. 22) on which the diameter of the recorded dot is enlarged, the table $t_A$ which decreases the aforesaid ratio of the number of dots is selected. Therefore, the number of ink droplets to be recorded on the cloth A is decreased. Hence, a high quality recorded image can be obtained similarly to the case where an image is recorded on the cloth B.

A plurality of the tables for converting the ratio N of the number of dots to be recorded are stored in a ROM provided for the image processing section 2 similarly to the aforesaid embodiment so as to be selected by the control section 9 in accordance with the type of the cloth. As an alternative to the linear conversion table, the conversion table may be a non-linear table to be adaptable to a subject cloth as shown in FIG. 29.

<Fourteenth Embodiment>

Figure 30:
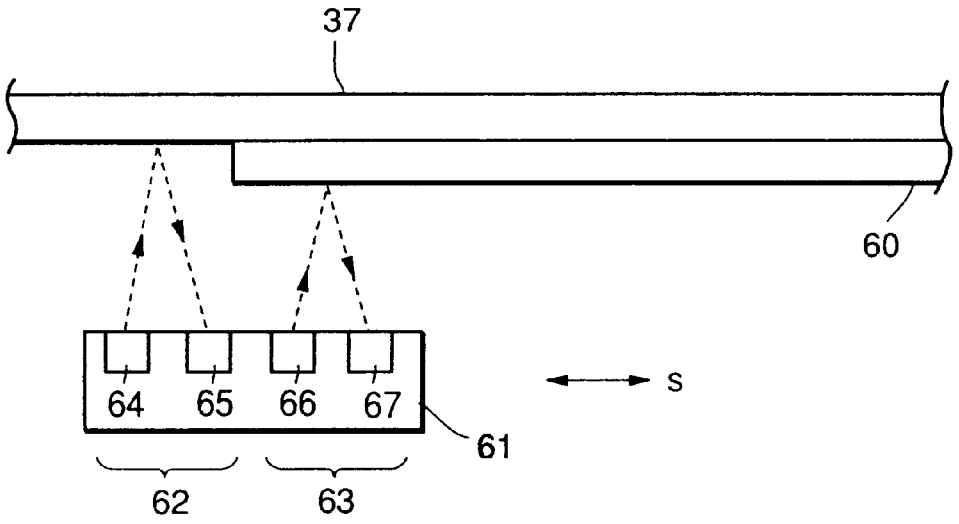
FIG. 30 illustrates an example of an automatic detection sensor for detecting thickness of the cloth as employed in a fourteenth embodiment of the present invention.
Figure 31:
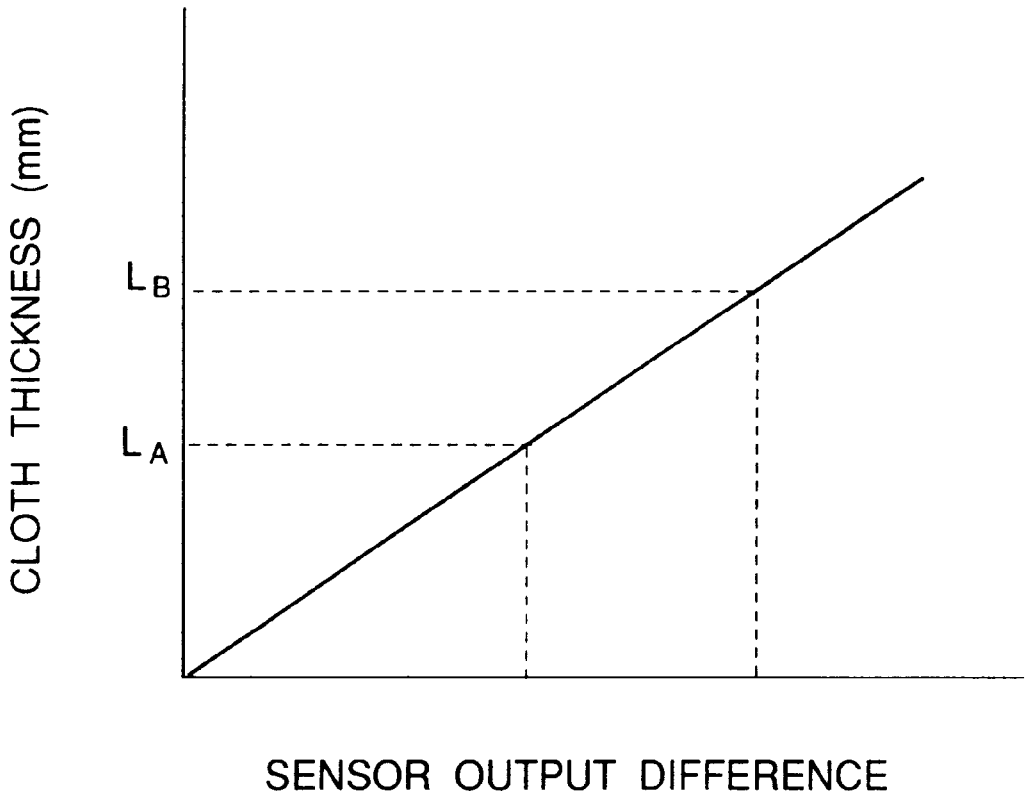
FIG. 31 is a graph which illustrates the relationship between the thickness of the cloth and the difference of outputs from the sensor of FIG. 30.

FIG. 30 illustrates a fourteenth embodiment having an arrangement that the thickness of the cloth is automatically detected by an optical detection means 61 disposed adjacent to the conveyance belt 37 downstream of the pressing roller 40. In this embodiment, the optical detection means 61 is constituted by a pair of optical sensors 62 and 63 having light emitting sections 64 and 66 composed of an LED and a pilot lamp and light receiving sections 65 and 67. The thickness of the cloth 60 is, as shown in FIG. 31, detected from the quantity of the difference between the output corresponding to the quantity of light emitted from the light emitting section 64 of the optical sensor 62, reflected by the conveyance belt 37 and received by the light receiving section 65 and an output corresponding to the quantity of light emitted from the light emitting section 66 of the optical sensor 63, reflected by the surface of the cloth 60 and received by the light receiving section 66.

As described above, according to the fourteenth embodiment, the cloth 60 can be protected from damage because the thickness of the cloth 60 can be detected in a non-contact manner. As an alternative to the aforesaid arrangement, an arrangement for detecting the thickness of the cloth 60 may be employed in which the optical detection mean 61 is constituted by a pair of a light emitting section and a light receiving section, the optical detection means 61 being mounted on the recording head 10 so as to be moved in parallel to the scanning direction S in order to measure the quantity of reflected light.

The thickness of the cloth 60 can be detected by a structure constituted in such a manner that the light emitting section is constituted by a semiconductor laser and the like and the conveyance belt 37 and the cloth 60 are irradiated with pulsed light beams emitted from the light emitting section so as to detect the thickness of the cloth 60 in accordance with the difference in a time taken for the reflected pulsed light beam to be received by the light receiving section.

<Fifteenth Embodiment>

Figure 32A:
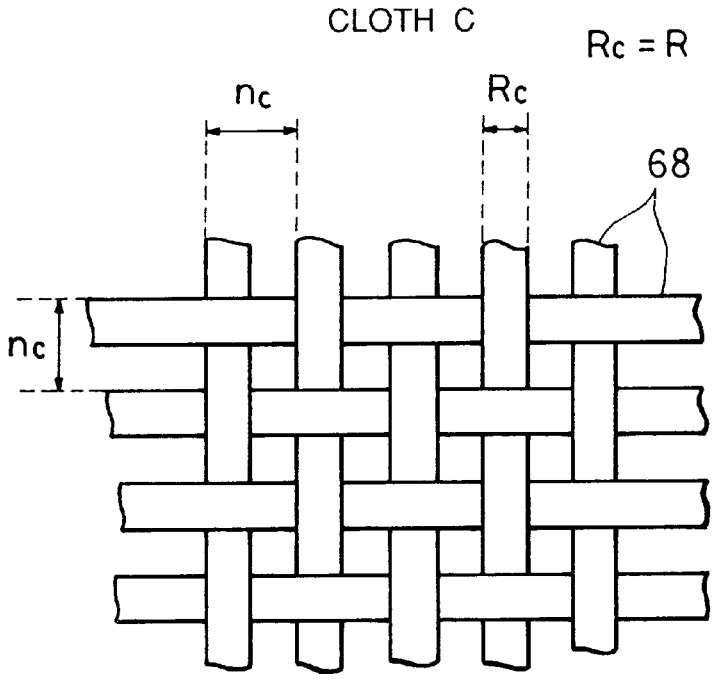
FIGS. 32(A) and 32(B) illustrate examples where the diameter R of the fiber of the cloth and the weaving pitch are different according to the fifteenth embodiment of the present invention.
Figure 32B:
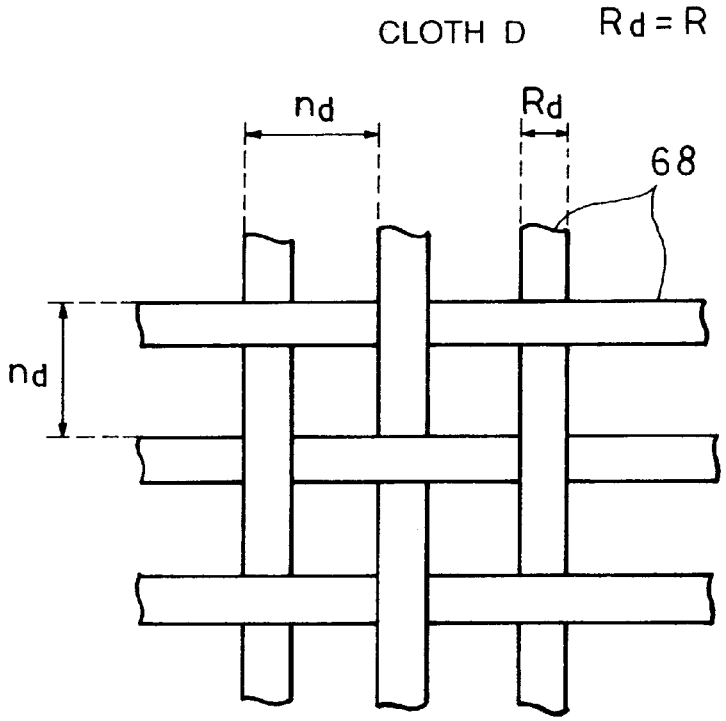
Figure 33:
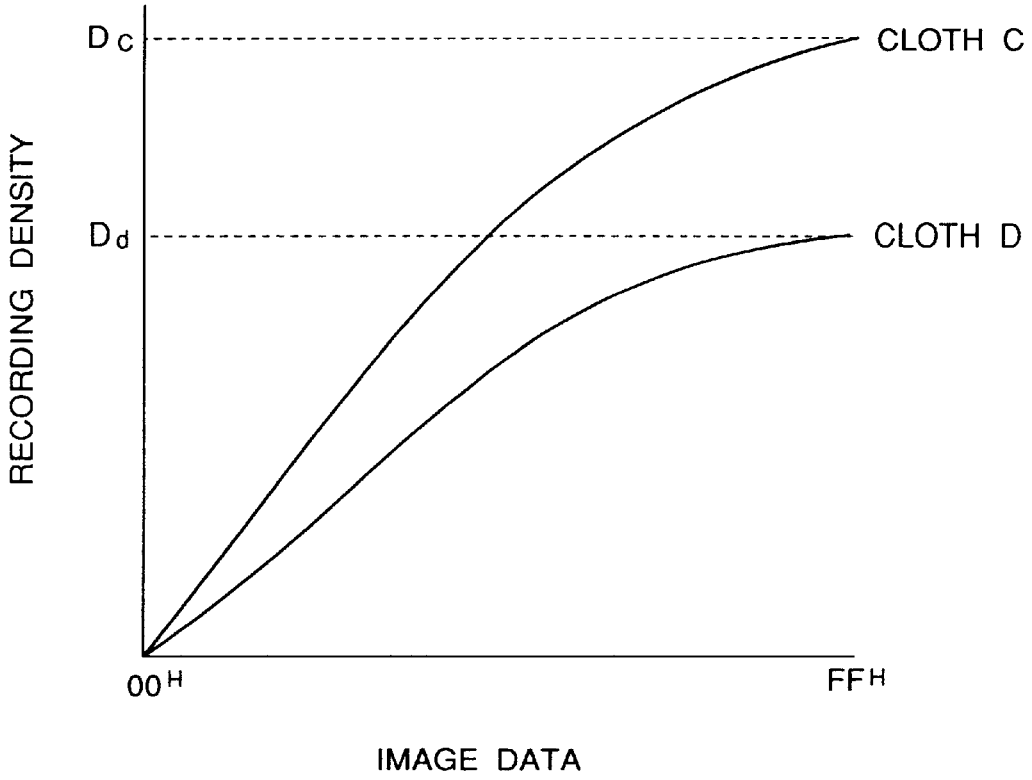
FIG. 33 illustrates the difference in the recording characteristics of the recording head in the examples where the diameter R of the fiber of the cloth and the weaving pitch are different as realized in the fifteenth embodiment of the present invention.

FIGS. 32 and 33 illustrate the difference in the recording characteristics realized by the recording head if the thickness R of the fiber or the weaving pitch n of the fiber is different. A consideration is made for a case where images are recorded on cloths C and D having the same fiber diameter R and different weaving pitches by discharging ink droplets from the recording head 10 as shown in FIGS. 32A and 32B. If an image is recorded on the cloth D having a long weaving pitch $n_d$, the number of the ink droplets among the ink droplets discharged from the recording head 10 which adhere to the surface of the fiber 68 of the cloth D is smaller than the number of ink droplets which adhere to the fiber 68 of the cloth C having a smaller weaving pitch $n_c$ ($n_c<n_d$) than that of the cloth D. As a result, the density $D_d$ of the image recorded on the cloth D is lowered as compared with that recorded on the cloth C as shown in FIG. 33. Also in the case where an image is recorded on a cloth having the same weaving pitch n and different fiber diameter R, the density of the image recorded on the cloth, the diameter of the fiber of which is smaller, is lowered. Therefore, the diameter of the fiber and the weaving pitch of the cloth can be detected and the conditions of the recording operation to be performed by the recording head 10 can be changed in accordance with the results of the detection.

This embodiment has a CCD sensor composed of a plurality of photoelectrical conversion elements and disposed to face the conveyance belt downstream of the pressing roller 40 so as to read the intensity of light emitted from a light source such as a florescent lamp or a halogen lamp and reflected by the surface of the cloth so that the thickness of the fiber of the cloth and the weaving pitch of the same are detected.

Figure 34:
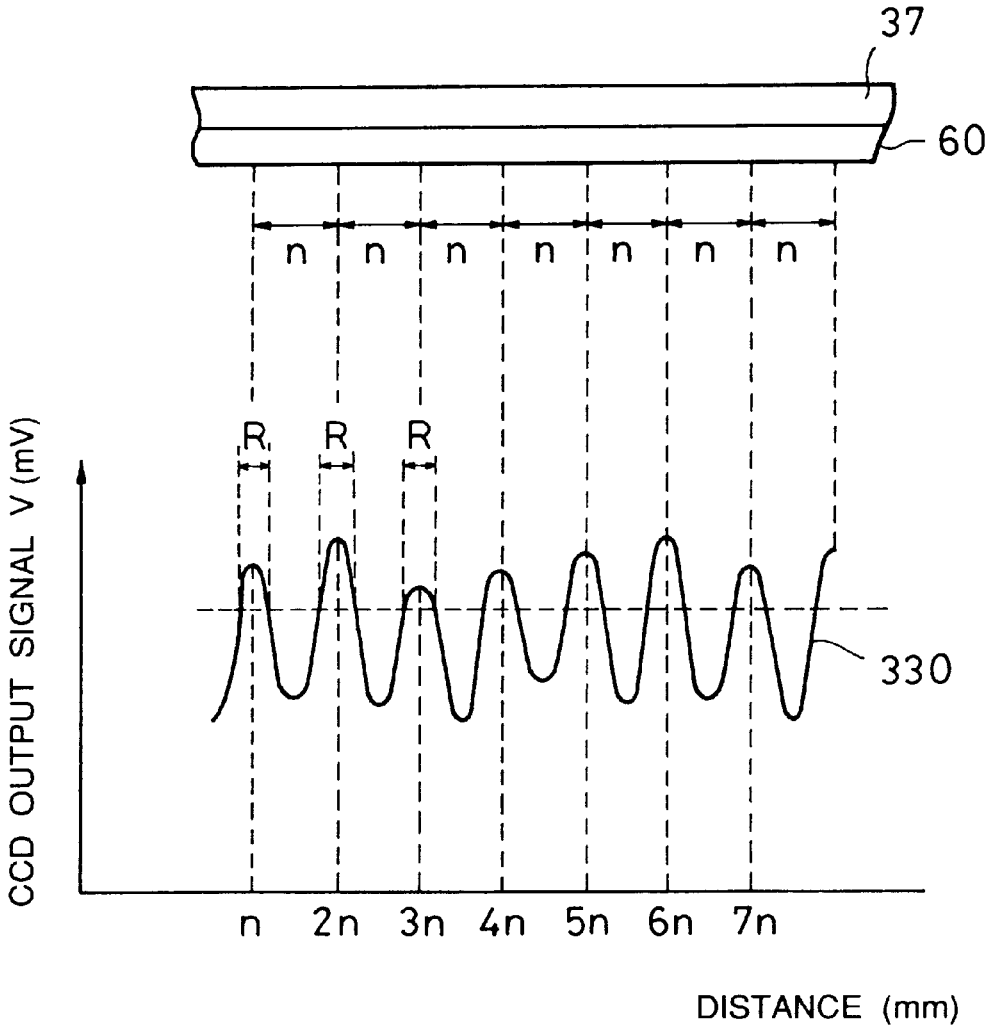
FIG. 34 illustrates an example of the intensity of light reflected by the cloth according to the fifteenth embodiment of the present invention.
Figure 35:
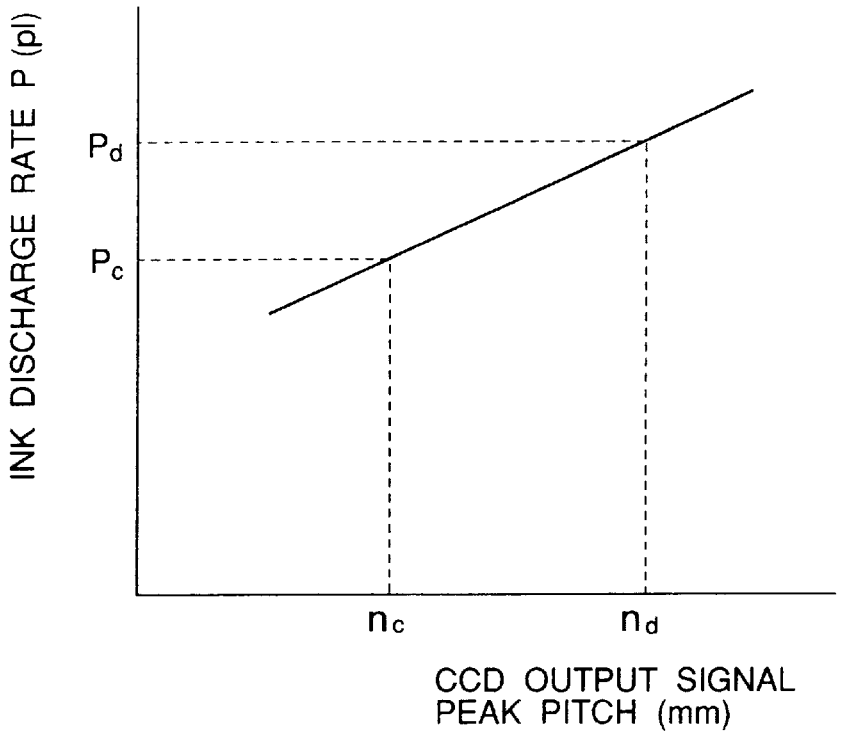
FIG. 35 is a graph which illustrates the relationship between the peak pitch of the output signal from a CCD sensor and the quantity of discharged ink realized according to the fifteenth embodiment of the present invention.

That is, a cloth 60 having a weaving pitch of n is conveyed by the conveyance belt 37 and the cloth 60 is irradiated with light emitted from a light source as shown in FIG. 34. The intensity of light reflected by the cloth 60 is detected by the CCD sensor disposed to face the cloth 60. As a result, a peak signal 330 having a period corresponding to the weaving pitch of the cloth 60 is outputted from the CCD sensor. Hence, the quantity P of ink discharged from the recording head 10 is changed in accordance with the pitch n of the peak signal 330 of the CCD sensor as shown in FIG. 35. If the weaving pitch nd is long as in the case of the cloth D, the CCD sensor outputs a signal having a long pitch. Therefore, a discrimination is made that the weaving pitch $n_d$ of the cloth D is longer than the pitch nc of the cloth C and the quantity of ink to be discharged from the recording head 10 is enlarged to $P_d$.

Figure 36:
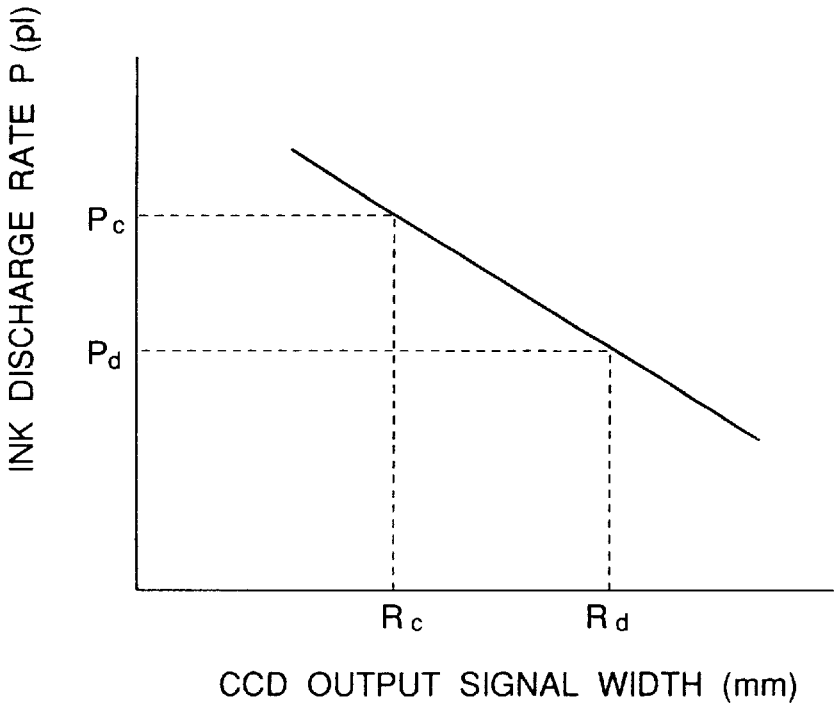
FIG. 36 is a graph which illustrates the relationship between the width of the output signal from the CCD sensor and the quantity of discharged ink realized according to the fifteenth embodiment of the present invention.

The diameter of the fiber of the cloth can be detected in accordance with the width of R of a pulse of an output signal from the CCD sensor having a periodic amplitude. If the width Rc of the pulse of the output signal from the CCD sensor generated in the case of the cloth C is shorter than the width $R_d$ of a pulse of an output signal generated in the case of the cloth D, a discrimination is made that the diameter of the fiber of the cloth C is thinner than that of the cloth D. As a result, as shown in FIG. 36, the quantity of ink to be discharged from the recording head 10 is enlarged to $P_c$ so as to raise the recording density at the time of recording an image on the cloth C.

Among the ink jet recording methods, a recording head or a recording apparatus of a type having an arrangement that heat energy is utilized to form a flying fluid droplet so as to perform the recording operation causes an excellent effect to be obtained.

As for the typical structure and the principle, it is preferable that the basic structure disclosed in, for example, U.S. Pat. Nos. 4,723,129 or 4,740,796 is employed. The aforesaid method can be adapted to both a so-called on-demand type apparatus and a continuous type apparatus. In particular, a satisfactory effect can be obtained when the on-demand type apparatus is employed because of the structure arranged in such a manner that one or more drive signals, which rapidly raise the temperature of an electricity-to-heat converter disposed to face a sheet or a fluid passage which holds the fluid (ink) to a level higher than levels at which nucleate boiling takes place are applied to the electricity-to-heat converter so as to generate heat energy in the electricity-to-heat converter and to cause at the heat effecting surface of the recording head film boiling to take place so that bubbles can be formed in the fluid (ink) to correspond to the one or more drive signals. The enlargement/contraction of the bubble will cause the fluid (ink) to be discharged through a discharging opening so that one or more droplets are formed. If a pulse shaped drive signal is employed, the bubble can be enlarged/contracted immediately and properly, causing a further preferred effect to be obtained because the fluid (ink) can be discharged with excellent responsiveness.

It is preferable that a pulse drive signal disclosed in U.S. Pat. Nos. 4,463,359 or 4,345,262 is employed. If conditions disclosed in U.S. Pat. No. 4,313,124, which relates to the temperature rising ratio at the heat effecting surface, are employed, a satisfactory recording result can be obtained.

As an alternative to the structure (linear fluid passage or perpendicular fluid passage) of the recording head disclosed in each of the aforesaid inventions and having an arrangement that discharge ports, fluid passages and electricity-to-heat converters are combined, a structure having an arrangement that the heat effecting surface is disposed in a bent region as disclosed in U.S. Pat. Nos. 4,558,333 or 4,459,600 may be employed. In addition, the following structures may be employed: a structure having an arrangement that a common slit is formed to serve as a discharge section of a plurality of electricity-to-heat converters as disclosed in Japanese Patent Laid-Open No. 59-123670; and a structure in which an opening for absorbing pressure waves of heat energy is disposed to correspond to the discharge section.

As a full-line type recording head having a length capable of covering the width of the largest recording medium which can be recorded by the recording apparatus, a structure enabled to have the length by combining a plurality of recording heads or a structure having a sole integrated recording head as disclosed in any of the aforesaid specifications may be employed.

A chip type recording head which can be electrically connected to the body of the apparatus or to which ink can be supplied from the body of the apparatus when it is fastened to the body of the apparatus may be employed. Furthermore, a cartridge recording head having an ink tank integrally formed with the recording head may be employed.

It is preferred to additionally employ the recording head restoring means and an auxiliary means provided as the component of the present invention because the effect of the present invention can be further stabilized. Specifically, it is preferable to employ any combination of a recording head capping means, a cleaning means, a pressurizing or suction means, an electricity-to-heat converter, an auxiliarly heating element or a sub-heating means constituted by combining the converter and the auxiliary heating element and a controller for effecting a sub-discharge mode in which a discharge is performed independently from the recording discharge in order to stably perform the recording operation.

The recording apparatus may be arranged to be capable of recording a color-combined image composed of different colors or a full color image obtained by mixing colors to each other by integrally forming the recording head or by combining a plurality of recording heads as well as recording only a main color such as black.

Although a fluid ink is employed in each of the aforesaid embodiments of the present invention, ink which is solidified at room temperature or lower and as well as softened at room temperature, or ink in the form of a fluid at room temperature or ink in the form of a fluid at room temperature, or ink which is formed into a fluid when the recording signal is supplied may be employed because the aforesaid ink jet recording method is ordinarily designed in such a manner that the temperature of ink is controlled in a range from 30° C. to 70° C. so as to keep the viscosity of the ink in a stable discharge range.

Furthermore, ink of the following types can be adapted to the present invention: ink which is liquified when heat energy is supplied in response to the recording signal so as to be discharged in the form of fluid ink, the aforesaid ink being exemplified by ink, the temperature rise of which due to supply of the heat energy is positively prevented by utilizing the temperature rise as energy of state change from the solid state to the liquid state; and ink which is solidified when it is unused for the purpose of preventing the ink evaporation. Furthermore, ink which is first liquified when supplied with heat energy may be adapted to the present invention. In the aforesaid case, the ink may be of a type which is held as fluid or solid material in a recess of a porous sheet or a through hole at a position to face the electricity-to-heat converter as disclosed in Japanese Patent Laid-Open No. 54-56847 or Japanese Patent Laid-Open No. 60-71260. It is most preferred that the ink be adapted to the aforesaid film boiling method.

The recording apparatus according to the present invention may be in the form of a copying apparatus combined with a reader or the like, or a facsimile apparatus having a transmission/receiving function as well as the integrated or independent apparatus serving as image output terminal equipment of information processing apparatus such as a word processor or computer.

The cloth for use in the ink jet printing operation must meet the following requirements:

(1) The cloth enables a satisfactory thick color to be attained from the ink.

(2) The cloth enables ink to display a high dyeing capability.

(3) The cloth enables ink to be quickly dried thereon.

(4) The cloth satisfactorily prevents irregular bleeding of ink.

(5) The cloth can be easily conveyed in the apparatus.

In order to meet the aforesaid requirements, the cloth must be subjected to a pre-treatment if necessary. For example, Japanese Patent Laid-Open No. 62-53492 has disclosed cloths of a type having an ink receiving layer. Japanese Patent Publication No. 3-46589 has disclosed cloths of a type containing a reduction inhibitor or an alkali substance. The pre-treatment is exemplified by a process in which the cloth contains a substance selected from a group consisting of an alkali substance, a water soluble polymer, a synthetic polymer, water soluble metal salt, and urea and thiourea.

The alkali substance is exemplified by alkali hydroxide metal such as sodium hydroxide and potassium hydroxide; amines such as mono, di- and triethanol amine; carbonic or bicarbonic alkali metal such as sodium carbonate, potassium carbonate, and sodium bicarbonate; ammonia; and ammonia compound. Furthermore, trichloroacetic sodium may be employed. It is preferable to employ sodium carbonate or sodium bicarbonate as the alkali substance.

The water soluble polymer is exemplified by starch such as corn and wheat flour; cellulose such as carboxymethyl cellulose, methylcellulose, and hydroxyethyl cellulose; polysaccharide such as sodium alginate, gum arabic, sweet bean gum, tragacanth gum, gua-gum, and tamarind seed; protein such as gelatin and casein; and natural water-soluble polymer such as tannin, and lignin.

The synthetic polymer is exemplified by polyvinyl alcohol compound, polyethylene oxide compound, acrylic acid type water soluble polymer, and maleic anhydride type water soluble polymer. It is preferable that a polysaccharide polymer or cellulose type polymer is employed.

The water-soluble metal salt is exemplified by a compound such as a halide of alkali metal and alkali earth metal which forms a typical ion crystal and having a pH value of 4 to 10. The alkali metal is exemplified by NaCl, $Na_2SO_4$, KCl and $CH_3COONa$, and the alkali earth metal is exemplified by $CaCl_2$ and $MgCl_2$. It is preferable to employ a salt of Na, K or Ca.

There is no particular limit in a method of causing the aforesaid substance to be contained by the cloth, the method being exemplified by a dipping method, a vat method, a coating method and a spraying method.

Since ink to be printed on the ink jet printing cloth simply adheres to the cloth when it is supplied to the same, it is preferable to be subjected to an ensuing reaction fixing process (a dyeing method) in which the dye is fixed to the fiber. The reaction fixing process may be a known method exemplified by a steaming method, a HT steaming method, and a thermofixing method. If a cloth which is not previously subjected to the alkali process is used, an alkali pad steam method, an alkali blotch steam method, an alkali shock method or an alkali cold fixing method is employed.

The substances for use to remove the un-reacted dye and in the pre-treatment can be removed by a known cleaning method after the aforesaid reaction fixing process has been completed. It is preferable that the conventional fixing process is performed when the aforesaid cleaning process is performed.

The recorded product applied with additional treatments as mentioned above is then divided into pieces each having a desired size. The divided pieces are treated with a final process, such as sewing, adhesion and solvent welding to obtain final products, for example clothes such as one-piece or two-piece dresses, ties, swimming suits, pants, bedspreads, covers for sofas, handkerchiefs and curtains. Cloths made of materials such as cotton or silk and others are treated by, for example, sewing and made into clothes and other commodities as disclosed in MODERN KNITTING AND SEWING MANUAL published by Seni Journal (Fiber Journal), SOEN by Bunka Shuppan and many others.

The recording medium is not limited to the cloth or the woven fabric. It may be an unwoven fabric, paper, or plastic.

The present invention may be adapted to a system comprising a plurality of apparatuses or just one apparatus. The present invention may, of course, be adapted to the case where a program for executing the present invention is supplied.

As described above, according to the present invention, the necessity of using the screen stencil for use in the screen printing operation can be eliminated by directly printing an image on a cloth by employing the ink jet recording method in which small ink droplets are discharged to record an image. Therefore, the manufacturing process steps and time until the image is printed on the cloth can be significantly reduced. Furthermore, the size of the apparatus can be reduced and an image can be recorded on a variety of cloths while maintaining satisfactory quality.

Although the invention has been described in its preferred form with a certain degree of particularly, it is understood that the present disclosure of the preferred embodiments may be changed in the details of construction and any combination and arrangement of parts may be resorted to without departing from the spirit and the scope of the invention as hereinafter claimed.

What is claimed is:

1. An image printing apparatus for moving, relatively to a recording medium which is a of cloth made of woven fibers, a recording head for discharging ink so as to record an image, said apparatus comprising:

detecting means for generating an instruction signal based on a detected diameter of a fiber forming the cloth and a detected weaving pitch of the fibers of the cloth; and recording control means for changing operation conditions of the recording head in accordance with the instruction signal generated by said detecting means.

2. An image recording apparatus according to claim 1, wherein said recording head comprises an ink jet recording head and said recording control means changes a level of voltage to be applied to the recording head.

3. An image recording apparatus according to claim 1, wherein the recording head comprises an ink jet recording head and said recording control means changes a width of a pulse to be applied to the recording head.

4. An image recording apparatus according to claim 1, wherein said recording head comprises an ink jet recording head for discharging ink by utilizing heat energy, the ink jet recording head having a heat energy converter for generating the heat energy applied to the ink.

5. An image recording method comprising the steps of:

providing an image recording apparatus for moving, relatively to a recording medium which is a of cloth made of woven fibers, a recording head for discharging ink so as to record an image;

detecting a diameter of a fiber forming the cloth and a weaving pitch of the fibers of the cloth;

changing operation conditions of the recording head in accordance with a detection result in said detecting step;

applying ink to the cloth using the image recording apparatus; and fixing the applied ink to the cloth.

6. An image recording method according to claim 5, further including the step of providing the cloth with a pre-treatment agent before said applying step.

7. An image recording apparatus for moving, relatively to a recording medium which is a of cloth made of woven fibers, a recording head for discharging ink so as to record an image, said apparatus comprising:

detection means for detecting one of a diameter of a fiber of the cloth and a weaving pitch of the fibers of the cloth;

generating means for generating a detection signal according to a detection by said detection means; and recording control means for changing operation conditions of the recording head in accordance with the detection signal generated by said generating means.

8. An image recording apparatus according to claim 7, wherein the recording head comprises an ink jet recording head and said recording control means changes a level of voltage to be applied to the recording head.

9. An image recording apparatus according to claim 7, wherein the recording head comprises an ink jet recording head and said recording control means changes a width of a pulse to be applied to the recording head.

10. An image recording apparatus according to claim 7, wherein the recording head comprises an ink jet recording head for discharging ink by utilizing heat energy, the ink jet recording head having a heat energy converter for generating the heat energy to be applied to the ink.

11. An image recording method comprising the steps of:

providing an image recording apparatus for moving, relatively to a recording medium which is a of cloth made of woven fibers, a recording head for discharging ink so as to record an image;

detecting one of a diameter of a fiber of the cloth and a weaving pitch of the fibers of the cloth;

generating a detection signal according to a detection by said detecting step;

changing operation conditions of the recording head in accordance with the detection signal generated in said generating step;

applying ink to the cloth using the image recording apparatus; and fixing the applied ink to the cloth.

12. An image recording method according to claim 11, further including a step of providing the cloth with a pre-treatment agent before said ink applying step.

13. An image recording apparatus for moving, relatively to a recording medium in the form of a cloth, a recording head for discharging ink so as to record an image, said apparatus comprising:

determining means for determining a type of the cloth recording medium based on a diameter of a fiber forming the cloth and a weaving pitch of the fibers of the cloth;

heating means for heating the recording head;

temperature detection means for detecting a temperature of the recording head; and heating control means for controlling said heating means so as to maintain the temperature of the recording head at a desired level in accordance with the type of the recording medium determined by said determining means.

14. An image recording apparatus according to claim 13, wherein the recording head comprises an ink jet recording head for discharging ink by utilizing heat energy, the recording head having a heat energy converter for generating the heat energy to be applied to the ink.

15. An image recording method comprising the steps of:

providing an image recording apparatus for moving, relatively to a recording medium which is a of cloth, a recording head for discharging ink so as to record an image;

determining a type of the recording medium based on a diameter of a fiber forming the cloth and a weaving pitch of the fibers of the cloth;

heating the recording head;

detecting a temperature of the recording head;

controlling the heating so as to maintain the temperature of the recording head at a desired level in accordance with the type of the recording medium determined in said determining step;

applying ink to the recording medium using the image recording apparatus; and fixing the applied ink to the recording medium.

16. An image recording method as claimed in claim 15, further including a step of providing the recording medium with a pre-treatment agent before said ink applying step.

17. An image recording apparatus for moving, relatively to a recording medium which is a of cloth, a recording head for discharging ink so as to record an image, the apparatus comprising:

judging means for judging a type of the cloth recording medium based on an ink absorption characteristic; and changing means for changing an operation frequency of the recording head in accordance with the type of the cloth recording medium judged by said judging means.

18. An image recording apparatus according to claim 17, wherein the recording head comprises an ink jet recording head for discharging ink by utilizing heat energy, the recording head having a heat energy converter for generating the heat energy to be applied to the ink.

19. An image recording apparatus according to claim 17, wherein said judging means determines a thickness of the cloth recording medium.

20. An image recording apparatus for moving, relatively to a recording medium which is a of cloth, a recording head for discharging ink so as to record an image, the apparatus comprising:

determining means for determining a type of the cloth recording medium based on an ink absorption characteristic;

changing means for changing an operation frequency of the recording head in accordance with the type of the cloth recording medium determined by said determining means; and control means for controlling a number of times the recording head is moved relatively to the cloth recording medium in order to record a predetermined region in accordance with the type of cloth recording medium determined by said determining means.

21. An image recording apparatus for moving, relatively to a recording medium which is a of cloth, a recording head for discharging ink so as to record an image, the apparatus comprising:

determining means for determining a type of the cloth recording medium based on an ink absorption characteristic; and changing means for changing an operation frequency of the recording head in accordance with the type of the cloth recording medium determined by said determining means, wherein said determining means determines a thickness of a fiber of the cloth recording medium.

22. An image recording apparatus for moving, relatively to a recording medium which is a of cloth, a recording head for discharging ink so as to record an image, the apparatus comprising:

determining means for determining a type of the cloth recording medium based on an ink absorption characteristic; and changing means for changing an operation frequency of the recording head in accordance with the type of the cloth recording medium determined by said determining means, wherein said determining means determines a weaving pitch of fibers of the cloth recording medium.

23. An image recording method comprising the steps of:

providing an image recording apparatus for moving, relatively to a recording medium which is a of cloth, a recording head for discharging ink so as to record an image;

determining a type of the cloth recording medium;

changing an operation frequency of the recording head in accordance with the type of the cloth recording medium determined in said determining step;

applying ink to the recording medium by using the image recording apparatus; and fixing the applied ink to the recording medium.

24. An image recording method according to claim 23, further including a step of providing the cloth recording medium with a pre-treatment agent before said ink applying step.

25. A method for determining operation conditions of a recording head for image recording on a recording medium which is a of cloth made of woven fibers, said method comprising the steps of:

determining information relating to one of a diameter of a fiber of the cloth and a weaving pitch of the fibers of the cloth; and determining operation conditions of the recording head in accordance with the information determined in said information determining step.

26. A method according to claim 25, further including a step of applying ink to the cloth with the recording head based on the operation conditions determined in said operation conditions determining step.

27. A method according to claim 25, wherein the operation conditions comprise driving data of the recording head.

28. An image recording apparatus for moving, relatively to a recording medium which is a cloth made of woven fibers, a recording head for discharging ink so as to record an image, said apparatus comprising:

judging means for judging a type of the recording medium based on an ink absorption characteristic; and changing means for changing a driving operation of the recording head in accordance with the type of the recording medium judged by said judging means, wherein one type of the recording medium and another type of recording medium have a difference including at least one of a diameter of a fiber of the cloth and a weaving pitch of the fiber of the cloth.

29. An image recording apparatus according to claim 28, wherein the driving operation is an operation frequency.

* * * * *

UNITED STATES PATENT AND TRADEMARK OFFICE

CERTIFICATE OF CORRECTION

PATENT NO. : 6,151,040
DATED : November 21, 2000
INVENTOR(S) : Takada et al.

It is certified that error appears in the above-identified patent and that said Letters Patent is hereby corrected as shown below:

Title page,
Item [56] References Cited:
FOREIGN PATENT DOCUMENTS, "3150177" should read -- 3-150177 --, "3046589" should read -- 3-46589 --, and "3155951" should read -- 3-155951 --.

Column 2,
Line 21, "ink-so" should read -- ink so --.

Column 3,
Line 19, "Widths" should read -- widths --.
Line 56, "oth" should read -- cloth --.
Line 60, "the, " should read -- the --.
Line 62, "eibodiment" should read -- embodiment --.

Column 5,
Line 21, "a" should be deleted and "including" should read -- includes --.

Column 10,
Line 28, "he after" should read -- heater --.
Line 35, "afore said" should read -- aforesaid --.
Line 36, "t o" should read -- to --.
Line 49, "f low" should read -- flow --.

Column 11,
Line 31, "10o" should read -- 10. --.

Column 13,
Line 2, "o f" should read -- of --.
Line 11, "similarly t o t hat" should read -- similar to that --.
Line 45, "10c," should read -- 10c, --.
Line 52, "10c," should read -- 10c, --.
Line 63, "10c," should read -- 10c, --.
Line 67, "10c," should read -- 10c, --.

Column 14,
Line 11, $X_B/V$." should read $_{XB}/_V$ . --.
Line 13, "10c, " should read -- 10c, --.

UNITED STATES PATENT AND TRADEMARK OFFICE

CERTIFICATE OF CORRECTION

PATENT NO. : 6,151,040
DATED : November 21, 2000
INVENTOR(S) : Takada et al.

It is certified that error appears in the above-identified patent and that said Letters Patent is hereby corrected as shown below:

Column 22,
Line 8, "of" (first occurrence) should be deleted.
Line 32, "of" should be deleted.
Line 46, "of" (first occurrence) should be deleted.

Column 23,
Line 6, "of" should be deleted.
Line 23, "in the form of" should read -- which is --.
Line 45, "of" should be deleted.
Line 65, "of" should be deleted.

Column 24,
Line 15, "of" should be deleted.
Line 31, "of" should be deleted.
Line 44, "of" should be deleted.
Line 58, "of" should be deleted.

Column 25,
Line 8, "of" (first occurrence) should be deleted.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*